US011212887B2

(12) United States Patent
Reed

(10) Patent No.: US 11,212,887 B2
(45) Date of Patent: Dec. 28, 2021

(54) LIGHT HAVING SELECTIVELY ADJUSTABLE SETS OF SOLID STATE LIGHT SOURCES, CIRCUIT AND METHOD OF OPERATION THEREOF, TO PROVIDE VARIABLE OUTPUT CHARACTERISTICS

(71) Applicant: Express Imaging Systems, LLC, Renton, WA (US)

(72) Inventor: William G. Reed, Seattle, WA (US)

(73) Assignee: Express Imaging Systems, LLC, Renton, WA (US)

( * ) Notice: Subject to any disclaimer, the term of this patent is extended or adjusted under 35 U.S.C. 154(b) by 0 days.

(21) Appl. No.: 17/088,395

(22) Filed: Nov. 3, 2020

(65) Prior Publication Data

US 2021/0136886 A1 May 6, 2021

Related U.S. Application Data

(60) Provisional application No. 62/930,283, filed on Nov. 4, 2019.

(51) Int. Cl.
*H05B 45/10* (2020.01)
*H05B 45/345* (2020.01)
(Continued)

(52) U.S. Cl.
CPC ..... *H05B 45/10* (2020.01); *F21S 8/088* (2013.01); *F21V 29/503* (2015.01); *F21V 29/70* (2015.01);
(Continued)

(58) Field of Classification Search
CPC ..... H05B 45/00; H05B 45/10; H05B 45/20; H05B 45/345; H05B 45/48; F21V 29/503; F21V 29/70; F21S 8/088; F21W 2131/103
See application file for complete search history.

(56) References Cited

U.S. PATENT DOCUMENTS 2,240,050 A 4/1941 John
2,745,055 A 5/1956 Woerdemann
(Continued)

FOREIGN PATENT DOCUMENTS

CN 103162187 A 6/2013
DE 4001980 A1 8/1990
(Continued)

OTHER PUBLICATIONS

"Lcd Backlight I/O Ports and Power Protection Circuit Design," dated May 2, 2011, retrieved Jun. 10, 2011, from http://www.chipoy.info/gadgets/LCD-backlight-i-o-ports-and-power-pr . . . , 4 pages.
(Continued)

*Primary Examiner* — Jimmy T Vu
(74) *Attorney, Agent, or Firm* — Cozen O'Connor

(57) ABSTRACT

A light having a first set of electrically coupled solid state light sources having a first forward voltage drop and a second set of electrically coupled solid state light sources having a second forward voltage at least approximately matching the first forward voltage drop. The first set and second sets of solid state light sources are electrically coupled in parallel to a constant current source. A resistor is electrically coupled to at least one of the first and second sets of solid state light sources. Control circuitry is operably coupled to control a resistance electrically coupled in series with said at least one of the first set and the second set of solid state light sources to adjust a respective current therethrough and thereby dim said at least one of the first set and the second set of solid state light sources while maintaining the respective forward voltage drops.

20 Claims, 12 Drawing Sheets

(51) Int. Cl.

| | |
|---|---|
| ***H05B 45/48*** | (2020.01) |
| ***F21S 8/08*** | (2006.01) |
| ***F21V 29/503*** | (2015.01) |
| ***F21V 29/70*** | (2015.01) |
| ***H05B 45/20*** | (2020.01) |
| *F21W 131/103* | (2006.01) |

(52) U.S. Cl.
CPC ..... *H05B 45/20* (2020.01); *H05B 45/345* (2020.01); *H05B 45/48* (2020.01); *F21W 2131/103* (2013.01)

(56) References Cited

U.S. PATENT DOCUMENTS

| | | | |
|---|---|---|---|
| 3,374,396 | A | 3/1968 | Bell et al. |
| 4,153,927 | A | 5/1979 | Owens |
| 4,237,377 | A | 12/1980 | Sansum |
| 4,663,521 | A | 5/1987 | Maile |
| 5,086,379 | A | 2/1992 | Denison et al. |
| 5,160,202 | A | 11/1992 | Legare |
| 5,161,107 | A | 11/1992 | Mayeaux et al. |
| 5,230,556 | A | 7/1993 | Canty et al. |
| 5,276,385 | A | 1/1994 | Itoh et al. |
| 5,343,121 | A | 8/1994 | Terman et al. |
| 5,349,505 | A | 9/1994 | Poppenheimer |
| 5,450,302 | A | 9/1995 | Maase et al. |
| 5,508,589 | A | 4/1996 | Archdekin |
| 5,561,351 | A | 10/1996 | Vrionis et al. |
| 5,589,741 | A | 12/1996 | Terman et al. |
| 5,619,127 | A | 4/1997 | Warizaya |
| 5,808,294 | A | 9/1998 | Neumann |
| 5,838,226 | A | 11/1998 | Houggy et al. |
| 5,869,960 | A | 2/1999 | Brand |
| 5,892,331 | A | 4/1999 | Hollaway |
| 5,892,335 | A | 4/1999 | Archer |
| 5,936,362 | A | 8/1999 | Alt et al. |
| 5,995,350 | A | 11/1999 | Kopelman |
| 6,111,739 | A | 8/2000 | Wu et al. |
| 6,149,283 | A | 11/2000 | Conway et al. |
| 6,154,015 | A | 11/2000 | Ichiba |
| 6,160,353 | A | 12/2000 | Mancuso |
| 6,198,233 | B1 | 3/2001 | McConaughy |
| 6,211,627 | B1 | 4/2001 | Callahan |
| 6,377,191 | B1 | 4/2002 | Takubo |
| 6,612,720 | B1 | 9/2003 | Beadle |
| 6,674,060 | B2 | 1/2004 | Antila |
| 6,681,195 | B1 | 1/2004 | Poland et al. |
| 6,746,274 | B1 | 6/2004 | Verfuerth |
| 6,753,842 | B1 | 6/2004 | Williams et al. |
| 6,828,911 | B2 | 12/2004 | Jones et al. |
| 6,841,947 | B2 | 1/2005 | Berg-Johansen |
| 6,880,956 | B2 | 4/2005 | Zhang |
| 6,902,292 | B2 | 6/2005 | Lai |
| 6,985,827 | B2 | 1/2006 | Williams et al. |
| 7,019,276 | B2 | 3/2006 | Cloutier et al. |
| 7,066,622 | B2 | 6/2006 | Alessio |
| 7,081,722 | B1 | 7/2006 | Huynh et al. |
| 7,084,587 | B2 | 8/2006 | Archdekin et al. |
| 7,122,976 | B1 | 10/2006 | Smith et al. |
| 7,188,967 | B2 | 3/2007 | Dalton et al. |
| 7,190,121 | B2 | 3/2007 | Rose et al. |
| 7,196,477 | B2 | 3/2007 | Richmond |
| 7,218,056 | B1 | 5/2007 | Harwood |
| 7,239,087 | B2 | 7/2007 | Ball |
| 7,252,385 | B2 | 8/2007 | Engle et al. |
| 7,258,464 | B2 | 8/2007 | Morris et al. |
| 7,270,441 | B2 | 9/2007 | Fiene |
| 7,281,820 | B2 | 10/2007 | Bayat et al. |
| 7,294,973 | B2 | 11/2007 | Takahama et al. |
| 7,314,291 | B2 | 1/2008 | Tain et al. |
| 7,317,403 | B2 | 1/2008 | Grootes et al. |
| 7,322,714 | B2 | 1/2008 | Barnett et al. |
| 7,330,568 | B2 | 2/2008 | Nagaoka et al. |
| 7,339,323 | B2 | 3/2008 | Bucur |
| 7,339,471 | B1 | 3/2008 | Chan et al. |
| 7,405,524 | B2 | 7/2008 | Smith et al. |
| 7,438,440 | B2 | 10/2008 | Dorogi |
| 7,440,280 | B2 | 10/2008 | Shuy |
| 7,468,723 | B1 | 12/2008 | Collins |
| 7,524,089 | B2 | 4/2009 | Park |
| 7,538,499 | B2 | 5/2009 | Ashdown |
| 7,547,113 | B2 | 6/2009 | Lee |
| 7,559,674 | B2 | 7/2009 | He et al. |
| 7,564,198 | B2 | 7/2009 | Yamamoto et al. |
| 7,569,802 | B1 | 8/2009 | Mullins |
| 7,578,596 | B2 | 8/2009 | Martin |
| 7,578,597 | B2 | 8/2009 | Hoover et al. |
| 7,623,042 | B2 | 11/2009 | Huizenga |
| 7,627,372 | B2 | 12/2009 | Vaisnys et al. |
| 7,631,324 | B2 | 12/2009 | Buonasera et al. |
| 7,633,463 | B2 | 12/2009 | Negru |
| 7,638,743 | B2 | 12/2009 | Bartol et al. |
| 7,665,862 | B2 | 2/2010 | Villard |
| 7,677,753 | B1 | 3/2010 | Wills |
| 7,688,002 | B2 | 3/2010 | Ashdown et al. |
| 7,688,222 | B2 | 3/2010 | Peddie et al. |
| 7,697,925 | B1 | 4/2010 | Wilson et al. |
| 7,702,135 | B2 | 4/2010 | Hill et al. |
| 7,703,951 | B2 | 4/2010 | Piepgras et al. |
| 7,746,003 | B2 | 6/2010 | Verfuerth et al. |
| D621,410 | S | 8/2010 | Verfuerth et al. |
| D621,411 | S | 8/2010 | Verfuerth et al. |
| 7,798,669 | B2 | 9/2010 | Trojanowski et al. |
| 7,804,200 | B2 | 9/2010 | Flaherty |
| 7,828,463 | B1 | 11/2010 | Willis |
| 7,834,922 | B2 | 11/2010 | Kurane |
| 7,872,423 | B2 | 1/2011 | Biery et al. |
| 7,932,535 | B2 | 4/2011 | Mahalingam et al. |
| 7,940,191 | B2 | 5/2011 | Hierzer |
| 7,952,609 | B2 | 5/2011 | Simerly et al. |
| 7,960,919 | B2 | 6/2011 | Furukawa |
| 7,983,817 | B2 | 7/2011 | Breed |
| 7,985,005 | B2 | 7/2011 | Alexander et al. |
| 8,100,552 | B2 | 1/2012 | Spero |
| 8,118,456 | B2 | 2/2012 | Reed et al. |
| 8,143,769 | B2 | 3/2012 | Li |
| 8,174,212 | B2 | 5/2012 | Tziony et al. |
| 8,183,797 | B2 | 5/2012 | McKinney |
| 8,207,830 | B2 | 6/2012 | Rutjes et al. |
| 8,260,575 | B2 | 9/2012 | Walters et al. |
| 8,290,710 | B2 | 10/2012 | Cleland et al. |
| 8,324,840 | B2 | 12/2012 | Shteynberg et al. |
| 8,334,640 | B2 | 12/2012 | Reed et al. |
| 8,344,665 | B2 | 1/2013 | Verfuerth et al. |
| 8,376,583 | B2 | 2/2013 | Wang et al. |
| 8,378,563 | B2 | 2/2013 | Reed et al. |
| 8,390,475 | B2 | 3/2013 | Feroldi |
| 8,395,329 | B2 | 3/2013 | Jutras et al. |
| 8,427,076 | B2 | 4/2013 | Bourquin et al. |
| 8,436,556 | B2 | 5/2013 | Eisele et al. |
| 8,445,826 | B2 | 5/2013 | Verfuerth |
| 8,450,670 | B2 | 5/2013 | Verfuerth et al. |
| 8,457,793 | B2 | 6/2013 | Golding et al. |
| 8,476,565 | B2 | 7/2013 | Verfuerth |
| 8,508,137 | B2 | 8/2013 | Reed |
| 8,541,950 | B2 | 9/2013 | Reed |
| 8,547,022 | B2 | 10/2013 | Summerford et al. |
| 8,586,902 | B2 | 11/2013 | Verfuerth |
| 8,604,701 | B2 | 12/2013 | Verfuerth et al. |
| 8,610,358 | B2 | 12/2013 | Reed |
| 8,629,621 | B2 | 1/2014 | Reed |
| 8,674,608 | B2 | 3/2014 | Holland et al. |
| 8,749,403 | B2 | 6/2014 | King et al. |
| 8,749,635 | B2 | 6/2014 | Hogasten et al. |
| 8,764,237 | B2 | 7/2014 | Wang et al. |
| 8,779,340 | B2 | 7/2014 | Verfuerth et al. |
| 8,779,686 | B2 | 7/2014 | Jin |
| 8,810,138 | B2 | 8/2014 | Reed |
| 8,866,392 | B2 | 10/2014 | Chen |
| 8,866,582 | B2 | 10/2014 | Verfuerth et al. |
| 8,872,430 | B2 | 10/2014 | Yang |
| 8,872,964 | B2 | 10/2014 | Reed et al. |
| 8,878,440 | B2 | 11/2014 | Reed |
| 8,884,203 | B2 | 11/2014 | Verfuerth et al. |

(56) References Cited

U.S. PATENT DOCUMENTS 8,896,215 B2 11/2014 Reed et al.
8,901,825 B2 12/2014 Reed
8,921,751 B2 12/2014 Verfuerth
8,922,124 B2 12/2014 Reed et al.
8,926,138 B2 1/2015 Reed et al.
8,926,139 B2 1/2015 Reed et al.
8,975,827 B2 3/2015 Chobot et al.
8,987,992 B2 3/2015 Reed
8,988,005 B2 3/2015 Jungwirth et al.
9,002,522 B2 4/2015 Mohan et al.
9,024,545 B2 5/2015 Bloch et al.
9,084,310 B2 7/2015 Bedell et al.
9,107,026 B1 8/2015 Mswanadham et al.
9,119,270 B2 8/2015 Chen et al.
9,131,552 B2 9/2015 Reed et al.
9,185,777 B2 11/2015 Reed
9,204,523 B2 12/2015 Reed et al.
9,210,751 B2 12/2015 Reed
9,210,759 B2 12/2015 Reed
9,288,873 B2 3/2016 Reed
9,301,365 B2 3/2016 Reed
9,312,451 B2 4/2016 Reed et al.
9,357,618 B2 5/2016 Pandharipande et al.
9,414,449 B2 8/2016 Reed
9,433,062 B2 8/2016 Reed
9,445,485 B2 9/2016 Reed
9,450,347 B2 9/2016 Kondou et al.
9,462,662 B1 10/2016 Reed
9,466,443 B2 10/2016 Reed
9,497,393 B2 11/2016 Reed et al.
9,538,612 B1 1/2017 Reed
9,572,230 B2 2/2017 Reed
9,693,433 B2 6/2017 Reed et al.
9,713,228 B2 7/2017 Reed
9,781,797 B2 10/2017 Reed
9,801,248 B2 10/2017 Reed et al.
9,924,582 B2 3/2018 Vendetti et al.
9,930,758 B2 3/2018 Jayawardena et al.
9,967,933 B2 5/2018 Reed
10,009,983 B2 6/2018 Noesner
10,098,212 B2 10/2018 Vendetti et al.
10,219,360 B2 2/2019 Vendetti et al.
10,390,414 B2 8/2019 Vendetti et al.
10,433,382 B2 * 10/2019 Kottritsch ..... H05B 45/44
2002/0084767 A1 7/2002 Arai
2002/0113192 A1 8/2002 Antila
2003/0016143 A1 1/2003 Ghazarian
2003/0184672 A1 10/2003 Wu et al.
2004/0095772 A1 5/2004 Hoover et al.
2004/0105264 A1 6/2004 Spero
2004/0120148 A1 6/2004 Morris et al.
2004/0192227 A1 9/2004 Beach et al.
2004/0201992 A1 10/2004 Dalton et al.
2005/0099802 A1 5/2005 Lai
2005/0117344 A1 6/2005 Bucher et al.
2005/0135101 A1 6/2005 Richmond
2005/0174762 A1 8/2005 Fogerlie
2005/0174780 A1 8/2005 Park
2005/0179404 A1 8/2005 Veskovic et al.
2005/0231133 A1 10/2005 Lys
2005/0243022 A1 11/2005 Negru
2005/0254013 A1 11/2005 Engle et al.
2006/0001384 A1 1/2006 Tain et al.
2006/0014118 A1 1/2006 Utama
2006/0034075 A1 2/2006 Alessio
2006/0053459 A1 3/2006 Simerly et al.
2006/0066264 A1 3/2006 Ishigaki et al.
2006/0098440 A1 5/2006 Allen
2006/0114118 A1 6/2006 Toulmin et al.
2006/0133079 A1 6/2006 Callahan
2006/0146652 A1 7/2006 Huizi et al.
2006/0158130 A1 7/2006 Furukawa
2006/0202914 A1 9/2006 Ashdown
2006/0208667 A1 9/2006 Lys et al.
2006/0259080 A1 11/2006 Vaisnys et al.
2006/0262544 A1 11/2006 Piepgras et al.
2006/0277823 A1 12/2006 Barnett et al.
2007/0032990 A1 2/2007 Williams et al.
2007/0096118 A1 5/2007 Mahalingam et al.
2007/0102033 A1 5/2007 Petrocy
2007/0159819 A1 7/2007 Bayat et al.
2007/0164689 A1 7/2007 Suzuki
2007/0217093 A1 9/2007 Xue et al.
2007/0224461 A1 9/2007 Oh
2007/0225933 A1 9/2007 Shimomura
2007/0247853 A1 10/2007 Dorogi
2007/0279921 A1 12/2007 Alexander et al.
2008/0018261 A1 1/2008 Kastner
2008/0025020 A1 1/2008 Kolb
2008/0043106 A1 2/2008 Hassapis et al.
2008/0062687 A1 3/2008 Behar et al.
2008/0130304 A1 6/2008 Rash et al.
2008/0215279 A1 9/2008 Salsbury et al.
2008/0224623 A1 9/2008 Yu
2008/0232116 A1 9/2008 Kim
2008/0248837 A1 10/2008 Kunkel
2008/0266839 A1 10/2008 Claypool et al.
2008/0271065 A1 10/2008 Buonasera et al.
2008/0291661 A1 11/2008 Martin
2009/0046151 A1 2/2009 Nagaoka et al.
2009/0058320 A1 3/2009 Chou et al.
2009/0129067 A1 5/2009 Fan et al.
2009/0153062 A1 6/2009 Guo et al.
2009/0160358 A1 6/2009 Leiderman
2009/0161356 A1 6/2009 Negley et al.
2009/0167203 A1 7/2009 Dahlman et al.
2009/0195162 A1 8/2009 Maurer et al.
2009/0195179 A1 8/2009 Joseph et al.
2009/0230883 A1 9/2009 Haug
2009/0235208 A1 9/2009 Nakayama et al.
2009/0261735 A1 10/2009 Sibalich et al.
2009/0268023 A1 10/2009 Hsieh
2009/0273290 A1 11/2009 Ziegenfuss
2009/0278474 A1 11/2009 Reed et al.
2009/0278479 A1 11/2009 Platner et al.
2009/0284155 A1 11/2009 Reed et al.
2009/0309500 A1 12/2009 Reisch
2009/0315485 A1 12/2009 Verfuerth et al.
2010/0001652 A1 1/2010 Damsleth
2010/0052557 A1 3/2010 Van et al.
2010/0060130 A1 3/2010 Li
2010/0090577 A1 4/2010 Reed et al.
2010/0096460 A1 4/2010 Carlson et al.
2010/0123403 A1 5/2010 Reed
2010/0164406 A1 7/2010 Kost et al.
2010/0171442 A1 7/2010 Draper et al.
2010/0237711 A1 9/2010 Parsons
2010/0244708 A1 9/2010 Cheung et al.
2010/0246168 A1 9/2010 Verfuerth et al.
2010/0259193 A1 10/2010 Umezawa et al.
2010/0262296 A1 10/2010 Davis et al.
2010/0270945 A1 10/2010 Chang et al.
2010/0271802 A1 10/2010 Recker et al.
2010/0277082 A1 11/2010 Reed et al.
2010/0295454 A1 11/2010 Reed
2010/0295455 A1 11/2010 Reed
2010/0295946 A1 11/2010 Reed et al.
2010/0309310 A1 12/2010 Albright
2010/0328946 A1 12/2010 Borkar et al.
2011/0001626 A1 1/2011 Yip et al.
2011/0006703 A1 1/2011 Wu et al.
2011/0026264 A1 2/2011 Reed et al.
2011/0175518 A1 7/2011 Reed et al.
2011/0204845 A1 8/2011 Paparo et al.
2011/0215724 A1 9/2011 Chakravarty et al.
2011/0215731 A1 9/2011 Jeong et al.
2011/0221346 A1 9/2011 Lee et al.
2011/0222195 A1 9/2011 Benoit et al.
2011/0248812 A1 10/2011 Hu et al.
2011/0251751 A1 10/2011 Knight
2011/0282468 A1 11/2011 Ashdown
2011/0310605 A1 12/2011 Renn et al.
2012/0001566 A1 1/2012 Josefowicz et al.
2012/0001997 A1 1/2012 Takada

(56) References Cited

U.S. PATENT DOCUMENTS

2012/0019971 A1 1/2012 Flaherty et al.
2012/0038490 A1 2/2012 Verfuerth
2012/0098439 A1 4/2012 Recker et al.
2012/0119669 A1 5/2012 Melanson et al.
2012/0119682 A1 5/2012 Warton
2012/0143383 A1 6/2012 Cooperrider et al.
2012/0146518 A1 6/2012 Keating et al.
2012/0153854 A1 6/2012 Setomoto et al.
2012/0169053 A1 7/2012 Tchoryk et al.
2012/0169239 A1 7/2012 Chen et al.
2012/0181935 A1 7/2012 Velazquez
2012/0194054 A1 8/2012 Johnston et al.
2012/0206050 A1 8/2012 Spero
2012/0209755 A1 8/2012 Verfuerth et al.
2012/0221154 A1 8/2012 Runge
2012/0224363 A1 9/2012 Van
2012/0230584 A1 9/2012 Kubo et al.
2012/0242254 A1 9/2012 Kim et al.
2012/0262069 A1 10/2012 Reed
2012/0286770 A1 11/2012 Schroder et al.
2012/0299492 A1* 11/2012 Egawa ..... H05B 45/46 315/192
2013/0033183 A1 2/2013 Verfuerth et al.
2013/0043792 A1 2/2013 Reed
2013/0049613 A1 2/2013 Reed
2013/0057158 A1 3/2013 Josefowicz et al.
2013/0126715 A1 5/2013 Flaherty
2013/0131882 A1 5/2013 Verfuerth et al.
2013/0141000 A1 6/2013 Wei et al.
2013/0141010 A1 6/2013 Reed et al.
2013/0154488 A1 6/2013 Sadwick et al.
2013/0163243 A1 6/2013 Reed
2013/0193857 A1 8/2013 Tlachac et al.
2013/0210252 A1 8/2013 Ilyes
2013/0229518 A1 9/2013 Reed et al.
2013/0235202 A1 9/2013 Nagaoka et al.
2013/0249429 A1 9/2013 Woytowitz et al.
2013/0249479 A1 9/2013 Partovi
2013/0293112 A1 11/2013 Reed et al.
2013/0307418 A1 11/2013 Reed
2013/0313982 A1 11/2013 Reed
2013/0320862 A1 12/2013 Campbell et al.
2013/0340353 A1 12/2013 Whiting et al.
2014/0001961 A1 1/2014 Anderson et al.
2014/0028198 A1 1/2014 Reed et al.
2014/0028200 A1 1/2014 Van Wagoner et al.
2014/0055990 A1 2/2014 Reed
2014/0070964 A1 3/2014 Rupprath et al.
2014/0078308 A1 3/2014 Verfuerth
2014/0097759 A1 4/2014 Verfuerth et al.
2014/0139116 A1 5/2014 Reed
2014/0159585 A1 6/2014 Reed
2014/0166447 A1 6/2014 Thea et al.
2014/0203714 A1 7/2014 Zhang et al.
2014/0225521 A1 8/2014 Reed
2014/0244044 A1 8/2014 Davis et al.
2014/0252961 A1 9/2014 Ramer et al.
2014/0265894 A1 9/2014 Weaver
2014/0265897 A1 9/2014 Taipale et al.
2014/0313719 A1 10/2014 Wang et al.
2014/0320027 A1 10/2014 Reed
2014/0359078 A1 12/2014 Liu
2015/0015716 A1 1/2015 Reed et al.
2015/0028693 A1 1/2015 Reed
2015/0069920 A1 3/2015 Denteneer et al.
2015/0077019 A1 3/2015 Reed et al.
2015/0084520 A1 3/2015 Reed
2015/0123563 A1 5/2015 Dahlen
2015/0160305 A1 6/2015 Ilyes et al.
2015/0208479 A1 7/2015 Radermacher et al.
2015/0280782 A1 10/2015 Airbinger et al.
2015/0312983 A1 10/2015 Hu et al.
2016/0021713 A1 1/2016 Reed
2016/0037605 A1 2/2016 Reed et al.
2016/0113084 A1 4/2016 White et al.
2016/0150622 A1 5/2016 Flinsenberg et al.
2016/0234899 A1 8/2016 Reed et al.
2016/0286623 A1 9/2016 Reed
2016/0295656 A1 10/2016 Lenk
2016/0323955 A1 11/2016 Reed
2017/0055324 A1 2/2017 Reed
2017/0164439 A1 6/2017 Reed
2017/0311424 A1 10/2017 Vendetti et al.
2018/0035518 A1 2/2018 Cook
2018/0083438 A1 3/2018 Reed
2018/0083539 A1 3/2018 Reed
2018/0288860 A1 10/2018 Vendetti et al.
2018/0338367 A1 11/2018 Reed
2018/0352627 A1 12/2018 Seki et al.
2019/0394862 A1 12/2019 Vendetti et al.
2020/0029404 A1 1/2020 Reed
2020/0045794 A1 2/2020 Reed et al.

FOREIGN PATENT DOCUMENTS

EP 1734795 A1 12/2006
EP 2320713 A2 5/2011
EP 2559937 A1 2/2013
EP 2629491 A1 8/2013
EP 1459600 B1 2/2014
EP 2781138 A1 9/2014
FR 2883306 A1 9/2006
JP 6-335241 A 12/1994
JP 2001333420 A 11/2001
JP 2004279668 A 10/2004
JP 2004320024 A 11/2004
JP 2004349065 A 12/2004
JP 2005078403 A 3/2005
JP 2005093171 A 4/2005
JP 2005198238 A 7/2005
JP 2005310997 A 11/2005
JP 2006179672 A 7/2006
JP 2006244711 A 9/2006
JP 200859811 3/2008
JP 2008059811 A 3/2008
JP 2008509538 3/2008
JP 2008130523 A 6/2008
JP 2008159483 A 7/2008
JP 2008177144 A 7/2008
JP 2008529177 A 7/2008
JP 2008535279 A 8/2008
JP 2010504628 A 2/2010
JP 6335241 B2 5/2018
KR 20050078403 A 8/2005
KR 20060071869 A 6/2006
KR 20060086254 A 7/2006
KR 20080100140 A 11/2008
KR 20090042400 A 4/2009
KR 100935736 B1 1/2010
KR 2020100007230 7/2010
KR 101001276 B1 12/2010
KR 101044224 B1 6/2011
KR 101150876 B1 5/2012
WO 02076068 A1 9/2002
WO 02076069 A1 9/2002
WO 03/056882 7/2003
WO 03056882 A1 7/2003
WO 2005003625 A1 1/2005
WO 2006057866 A2 6/2006
WO 2007023454 A1 3/2007
WO 2007036873 A2 4/2007
WO 2008030450 A2 3/2008
WO 2008034242 A1 3/2008
WO 2009040703 A2 4/2009
WO 2010085882 A1 8/2010
WO 2010086757 A1 8/2010
WO 2010133719 A1 11/2010
WO 2011063302 A2 5/2011
WO 2011129309 A1 10/2011
WO 2012006710 A1 1/2012
WO 2012142115 A2 10/2012
WO 2013028834 A1 2/2013
WO 2013074900 A1 5/2013

(56) References Cited

FOREIGN PATENT DOCUMENTS

| | | | |
|---|---|---|---|
| WO | 2014018773 | A1 | 1/2014 |
| WO | 2014039683 | A1 | 3/2014 |
| WO | 2014078854 | A1 | 5/2014 |

OTHER PUBLICATIONS

EE Herald, "Devices to protect High brightness LED from ESD-,"dated Mar. 16, 2009, retrieved Jun. 10, 2011, from http://www.eeherald.com/section/new-products/np100779.html, 1 page.

Fairchild Semiconductor, "LED Application Design Guide Using Half-Bridge LLC Resonant Converter for 100W Street Lighting, "AN-9729, Fairchild Semiconductor Corporation, Rev. 1.0.0, Mar. 22, 2011, 17 pages.

Huang, "Designing an LLC Resonant Half-Bridge Power Converter, "2010 Texas Instruments Power Supply Design Seminar, SEMI900, Topic 3, TI Literature No. SLUP263, Copyright 2010, 2011, Texas Instruments Incorporated, 28 pages.

Kadirvel et al., "Self-Powered, Ambient Light Sensor Using bq25504," Texas Instruments, Application Report, SLUA629—Jan. 2012, 6 pages.

Littelfuse, "Application Note: Protecting LEDs in Product Designs," 2009, 2 pages.

Panasonic Electronic Components, "LED Lighting Solutions," 2009, 6 pages.

Tyco Electronics, "Circuit Protection," retrieved Jun. 10, 2011, retrieved from http://www.tycoelectronics.com/en/products/circuit-protection.html, 2 pages.

* cited by examiner

LIGHT HAVING SELECTIVELY ADJUSTABLE SETS OF SOLID STATE LIGHT SOURCES, CIRCUIT AND METHOD OF OPERATION THEREOF, TO PROVIDE VARIABLE OUTPUT CHARACTERISTICS

BACKGROUND

Technical Field

The present application is directed to a light, circuitry and method in which sets of solid state light sources are selectively adjustable to provide variable output characteristics, such as light distribution patterns and color temperatures.

Description of the Related Art

Lighting applications generally require lights with specific characteristics, such as specific illumination patterns, color temperatures, etc. Some lighting applications, such as roadway lighting, may require lights, e.g., luminaires, having characteristics which depend on the specifications of a particular installation. In such cases, it may be necessary to produce, install, and maintain a variety of different types of lights, each designed for a specific type of installation. Lights, e.g., luminaires, vehicle headlamps, including sets of solid state light sources may have characteristics which can be changed during use. For example, the brightness of a luminaire can be changed by dimming the solid state light sources contained therein. In conventional approaches, dimming of the solid state light sources may be performed using resistive elements, such as load resistors and potentiometers. In such cases, significant amounts of energy may be wasted due to power dissipation in the resistive elements.

BRIEF SUMMARY

A light may be summarized as including: a first set of one or more electrically coupled solid state light sources having a first forward voltage drop across the first set of solid state light sources; a second set of one or more electrically coupled solid state light sources having a second forward voltage drop across the second set of solid state light sources, the second forward voltage drop at least approximately matching the first forward voltage drop; a constant current source to which the first set of solid state light sources and at least the second set of solid state light sources are electrically coupled in parallel; at least one resistor electrically coupled to at least one of the first set and the second set of solid state light sources; and a set of control circuitry that is operably coupled to control a resistance electrically coupled in series with said at least one of the first set and the second set of solid state light sources, the resistance being provided by said at least one resistor, to adjust a respective current through said at least one of the first set and the second set of solid state light sources and thereby dim said at least one of the first set and the second set of solid state light sources while maintaining the respective forward voltage drop across the first set and the second set of solid state light sources substantially constant.

The set of control circuitry may be operably coupled to control the resistance electrically coupled in series with said at least one of the first set and the second set of solid state light sources, the resistance being provided by said at least one resistor, to adjust the respective current through said at least one of the first set and the second set of solid state light sources and thereby dim said at least one of the first set and the second set of solid state light sources and to brighten correspondingly another one of the first set and the second set of solid state light sources. The set of control circuitry may include: a shunt path bypassing said at least one resistor; and at least one switch operable in a first state to cause current to pass through said at least one resistor and operable in a second state to cause current to pass through the shunt path. The at least one switch may include a solid state switch. The at least one switch may include a mechanical or electromechanical switch. The at least one resistor may be a variable resistor and the set of control circuitry may be operable to adjust a resistance of the variable resistor. The first set and the second set of solid state light sources each may include a chip-on-board light emitting diode circuit. The first set and the second set of solid state light sources are communicatively coupled to a common isothermal structure comprising a heatsink. The first set and the second set of solid state light sources may have a negative thermal coefficient of less than about 3 millivolts per degree Celsius.

The first set of one or more solid state light sources may have a first correlated color temperature and the second set of one or more solid state light sources may have a second correlated color temperature, the first correlated color temperature being different from the second correlated color temperature, and the set of control circuitry may be operably coupled to control the resistance electrically coupled in series with said at least one of the first set and the second set of solid state light sources, the resistance being provided by said at least one resistor, to adjust the respective current through said at least one of the first set and the second set of solid state light sources and thereby dim said at least one of the first set and the second set of solid state light sources to output light having a combined correlated color temperature in a range between the first correlated color temperature and the second correlated color temperature. The second set of one or more solid state light sources may be arranged to extend along a first axis and at least the first set of one or more solid state light sources may be arranged to extend along a second axis, the second axis being non-parallel to the first axis. The second axis may be perpendicular to the first axis and the light may further include a mount positioned and oriented to allow installation of the light so that the first axis is aligned with an elongate area to provide maximum illumination to the elongate area and the second axis is aligned perpendicularly to the elongate area.

At least the first set of one or more solid state light sources may be selectively dimmable to form: a first illumination pattern; and a second illumination pattern, the second illumination pattern different than the first illumination pattern. The first illumination pattern may provide maximum illumination to an elongate area with a light distribution having a lateral width of between about 20 degrees and about 30 degrees, the second illumination pattern may provide maximum illumination to an elongate area with a light distribution having a lateral width of between about 30 degrees and about 50 degrees, and at least the first set of one or more solid state light sources may be selectively dimmable to further form a third illumination pattern which may provide maximum illumination to a circular area. The first, second, and third illumination patterns may correspond to IESNA Types II, III, and V light distribution patterns, respectively.

The light may further include: a third set of one or more electrically coupled solid state light sources having a third forward voltage drop across the third set of solid state light sources, the third forward voltage drop at least approximately matching the first forward voltage drop, wherein the first set, the second set, and the third set of solid state light sources are electrically coupled to the constant current source in parallel, said at least one resistor is electrically coupled to at least one of the first set, the second set, and the third set of solid state light sources, and the set of control circuitry is operably coupled to control a resistance electrically coupled in series with said at least one of the first set, the second set, and the third set of solid state light sources, the resistance being provided by said at least one resistor, to adjust a respective current through said at least one of the first set, the second set, and the third set of solid state light sources and thereby dim said at least one of the first set, the second set, and the third set of solid state light sources, wherein the control circuitry is operable to selectively dim one or more of the first, the second and the third sets of one or more solid state light sources to at least one of adjust a combined color temperature output by the light or to adjust a combined illumination pattern produced by the light.

A method to control a light may be provided, the light having a first set of one or more electrically coupled solid state light sources having a first forward voltage drop across the first set of solid state light sources, and a second set of one or more electrically coupled solid state light sources having a second forward voltage drop across the second set of solid state light sources, the second forward voltage drop at least approximately matching the first forward voltage drop. The method may be summarized as including: receiving current from a constant current source to which the first set of solid state light sources and at least the second set of solid state light sources are electrically coupled in parallel; and controlling, using an operably coupled set of control circuitry, a resistance electrically coupled in series with said at least one of the first set and the second set of solid state light sources, the resistance provided by at least one resistor electrically coupled to at least one of the first set and the second set of solid state light sources, to adjust a respective current through said at least one of the first set and the second set of solid state light sources and thereby dim said at least one of the first set and the second set of solid state light sources.

In said controlling the resistance electrically coupled in series with said at least one of the first set and the second set of solid state light sources to adjust the respective current through said at least one of the first set and the second set of solid state light sources and thereby dim said at least one of the first set and the second set of solid state light sources, the respective forward voltage drop across the first set and the second set of solid state light sources may remain substantially constant. The first set of one or more solid state light sources may have a first correlated color temperature and the second set of one or more solid state light sources may have a second correlated color temperature, the first correlated color temperature being different from the second correlated color temperature; and controlling the resistance electrically coupled in series with said at least one of the first set and the second set of solid state light sources to adjust the respective current through said at least one of the first set and the second set of solid state light sources may include controlling the resistance to output light having a combined correlated color temperature in a range between the first correlated color temperature and the second correlated color temperature.

The light may further include a third set of one or more electrically coupled solid state light sources having a third forward voltage drop across the third set of solid state light sources, and at least a fourth set of one or more electrically coupled solid state light sources having a fourth forward voltage drop across the fourth set of solid state light sources, the third and the fourth forward voltage drops at least approximately matching the first forward voltage drop, and at least one of the third or the fourth sets of one or more electrically coupled solid state light sources extending in a direction that is non-parallel a direction in which at least one of the first or the second sets of one or more electrically coupled solid state light sources extend, wherein controlling the resistance electrically coupled in series with said at least one of the first set and the second set of solid state light sources to adjust the respective current through said at least one of the first set and the second set of solid state light sources may include controlling a resistance electrically coupled in series with said first, second, third and fourth sets of one or more electrically coupled solid state light sources to select a throw pattern cast by the light.

BRIEF DESCRIPTION OF THE SEVERAL VIEWS OF THE DRAWINGS

In the drawings, identical reference numbers identify similar elements or acts. The sizes and relative positions of elements in the drawings are not necessarily drawn to scale. For example, the shapes of various elements and angles are not necessarily drawn to scale, and some of these elements are arbitrarily enlarged and positioned to improve drawing legibility. Further, the particular shapes of the elements as drawn, are not necessarily intended to convey any information regarding the actual shape of the particular elements, and have been solely selected for ease of recognition in the drawings.

DETAILED DESCRIPTION

Various implementations may employ two or more sets of solid state light sources, the sets forward voltage matched, and control circuitry that selectively dims some sets of light sources while maintaining the respective forward voltage drop across the sets of solid state light sources substantially constant by selectively providing respective shunt paths around resistances for the respective sets of solid state light sources. Such may advantageously be employed control an amount of illumination, a combined color temperature, and/or a throw pattern using a simple and reliable circuit.

Figure 1:
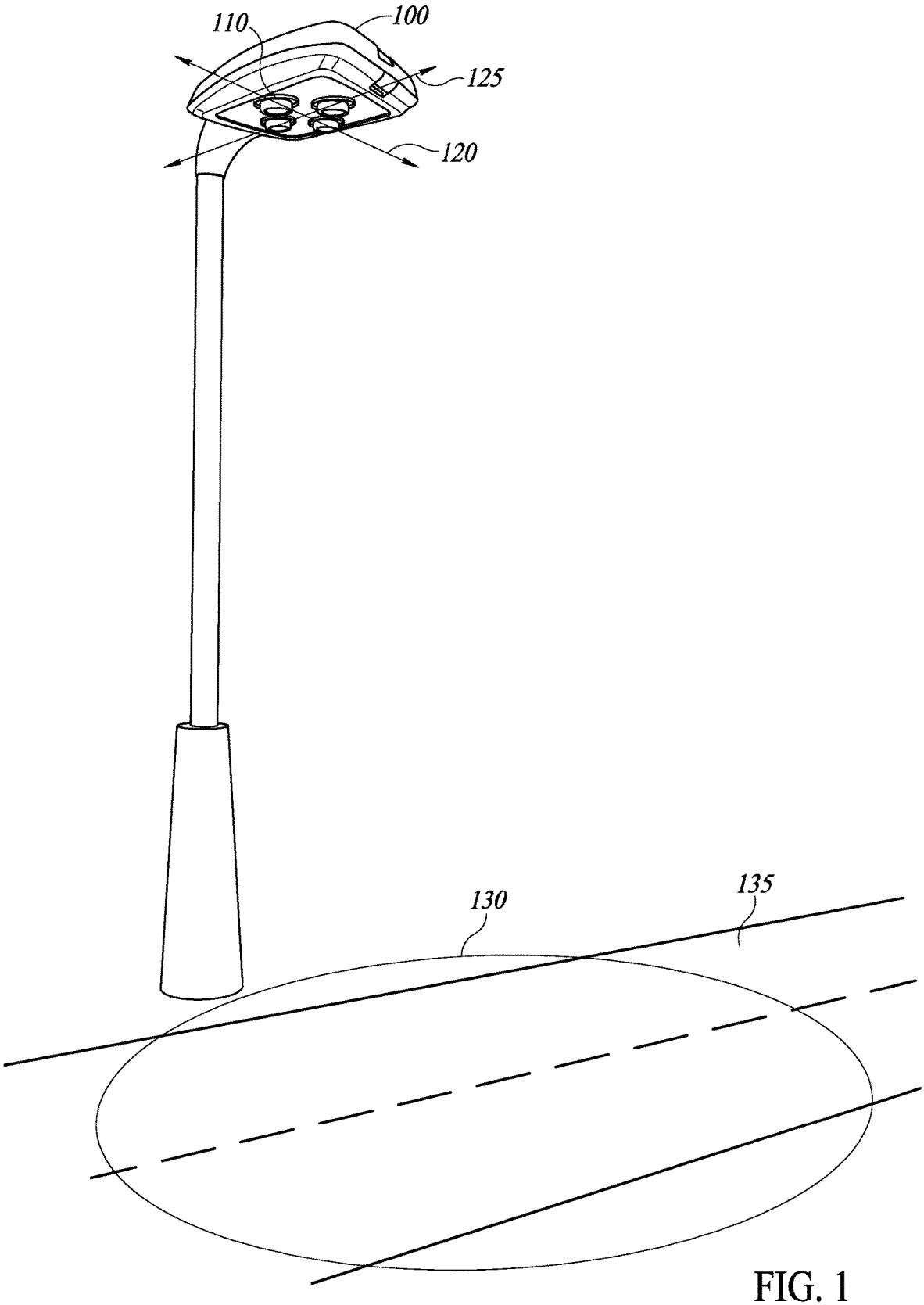
FIG. 1 is an isometric view of a light, in the form of a luminaire, positioned with respect to a elongate area, for example a roadway, the light having a plurality of sets of light sources arranged along two axes, the axes perpendicular to one another, and operable to produce two or more light distribution patterns to, for example, illuminate the elongate area, according to at least one illustrated implementation.

FIG. 1 shows a light, in the form of a luminaire 100, having two or more sets of light sources 110, e.g., solid state light sources, such as light emitting diodes (LED). In the example depicted, there is a first set of two light sources 110 (along a first axis 120) and a second set of two light sources 110 (along a second axis 125). As discussed in further detail below, a set of control circuitry may be provided in the luminaire 100 to adjust a respective current through the sets of light sources, thereby selectively dimming the sets of light sources 110.

The sets of light sources 110 may be arranged in sets of light sources, the light sources in each set electrically coupled in series with one another and operable together with one another. The light sources of each set of light sources may be aligned along a respective axis of the set, or may be distributed in some other pattern, for example aligned along a curve or along an arc, or positioned in a two-dimensional array. The sets of light sources may be arranged spatially and angularly offset from one another. For example, when arrayed along respective axes 120, 125, those axes 120, 125 may be non-parallel to one another, or even perpendicular to one another. This may allow the luminaire 100 to produce one or more light distribution patterns to illuminate an elongate area 130 of a surface, e.g., a roadway 135, according to at least one illustrated implementation.

The light sources 110 may be selectively dimmed to provide a different illumination pattern along each of the axes (120 and 125). In the example depicted, a first axis 120 of the two perpendicular axes is aligned with an elongate area 130 to be illuminated, e.g., a roadway 135 or pathway, ground or other area to be illuminated. A second axis 125 of the two perpendicular axes is non-parallel, e.g., perpendicular, with respect to the first axis 120, so as to be in a direction of roadside or path-side objects such as residences and buildings. In implementations, the light sources 110 of the luminaire 100 may include, e.g., two solid state light sources 110, e.g., light emitting diode (LED) light sources, arranged along the first axis 120 (one on each side of a center point where the axes intersect) and, e.g., two solid-state light sources 110 arranged along the second axis 125 (one on each side of the center point). Each of the solid-state light sources 110 may be constituted by a single or multiple individual solid-state elements, e.g., LEDs. In other implementations, there may be at least a first set (e.g., string) of LED light sources arranged along the first axis 120 (or, for example, two separate strings arranged on either side of the center point where the axes intersect) and at least a second string of LED light sources arranged along the second axis 125 (or, for example, two separate strings arranged on either side of the center point). The first and second sets of LED light sources may have the same or a different number of light sources. For example, in implementations, there may be more LED light sources in the set(s) of LED sources aligned with the first axis 120 than in the set(s) of LED light sources aligned with the second axis 125.

Figure 2:
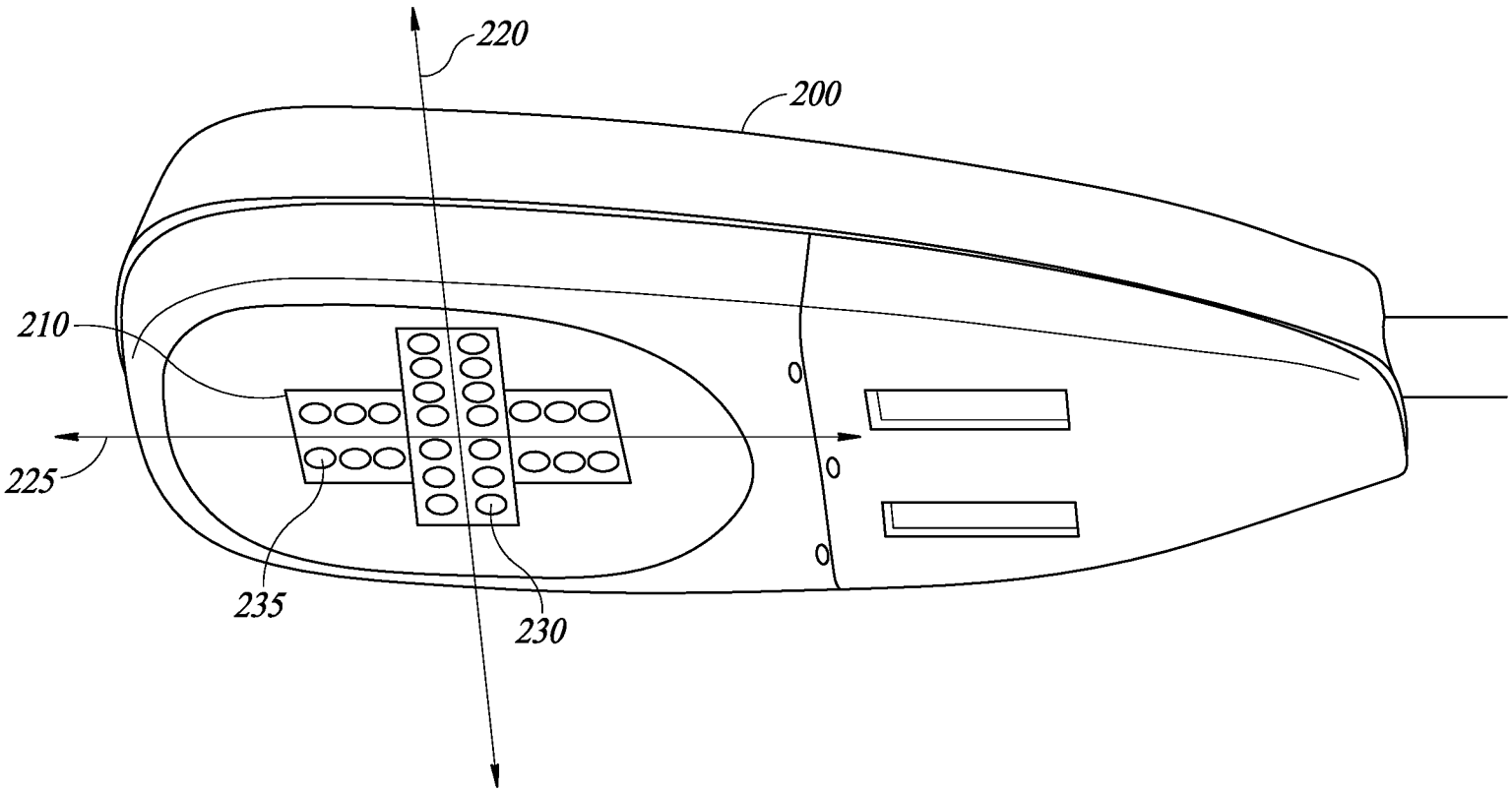
FIG. 2 is an isometric view of a light, in the form of a luminaire, having a plurality of sets of solid state light sources, the sets arranged along two axes, the axes perpendicular to one another, according to at least one illustrated implementation.

FIG. 2 shows a luminaire 200 having solid state light sources 210 arranged along two axes (220 and 225), according to at least one illustrated implementation. The first axis 220 may be aligned with an area to be illuminated (not shown), such as a roadway or pathway. The second axis 225 may be non-parallel, e.g., perpendicular, to the first axis 220. In the example depicted, a first set of solid state light sources 230, e.g., LEDs, is aligned with the first axis 220 and a second set of solid state light sources 235 is aligned with the second axis 225. The first set of LED light sources 230 may include a number of individual light sources in an elongate grid arrangement which includes multiple rows and columns of LEDs. The second set of LED light sources 235 may also include a number of individual light sources in an elongate grid arrangement. In implementations, the second set of LED light sources 235 may have a gap in a central portion thereof such that it extends from the sides of the first set of LED sources 230. Various other arrangements of LED light sources are also possible depending upon design requirements.

FIGS. 3A-3E depict a number of light distribution patterns established by the Illumination Engineering Society of North America (IESNA) for area, roadway, and pathway illumination. The light distribution patterns depicted are identified as Type I through Type V, respectively. Other light distribution classification systems are also in use such as the system established by the National Electrical Manufacturers Association (NEMA), which defines light distribution in terms of "beam spread."

Figure 3A:
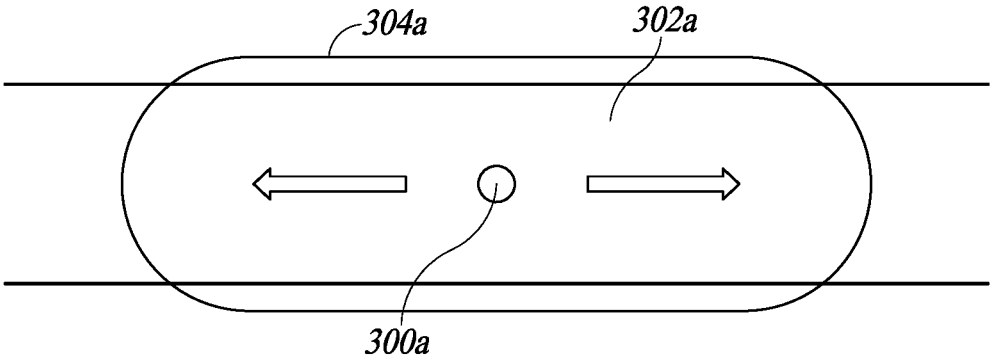
FIGS. 3A-3E are schematic diagrams showing Illumination Engineering Society light distribution patterns identified as Type I through Type V, respectively.

As shown in FIG. 3A, an IESNA Type I light distribution pattern 304*a*, is typically used for lighting roadways, walkways, paths, and sidewalks and is particularly suitable for narrower paths or roadways. In this type of light distribution pattern 304*a*, a light source 300*a* (or sources), e.g., a luminaire, is designed to be placed near the center of the roadway 302*a*. The Type I light distribution pattern 304*a* may be described as a two-way lateral distribution, with two concentrated light beams that illuminate in opposite directions. Type I distributions have a preferred lateral width, i.e., lateral angle, of 15 degrees in the cone of maximum candlepower and are best suited for the middle (e.g., median) of a highway or roadway that needs illumination on both sides of traffic flow. The two principal light concentrations are in opposite directions along the roadway 302*a*. This type of light distribution pattern 304*a* is generally applicable to a luminaire location near the center of a roadway 302*a* where the mounting height of the light source 300*a* is approximately equal to the roadway 302*a* width. In roadway lighting, the lateral angle is measured between a reference line and an illuminating width line in the cone of maximum candlepower. The illuminating width line is a radial line that passes through the point of one-half maximum candlepower on the lateral candlepower distribution curve plotted on the surface of the cone of maximum candlepower. The illuminating reference line is either of two radial lines where the surface of the cone of maximum candlepower is intersected by a vertical plane parallel to the curb line and passing through the light-center of the luminaire.

Figure 3B:
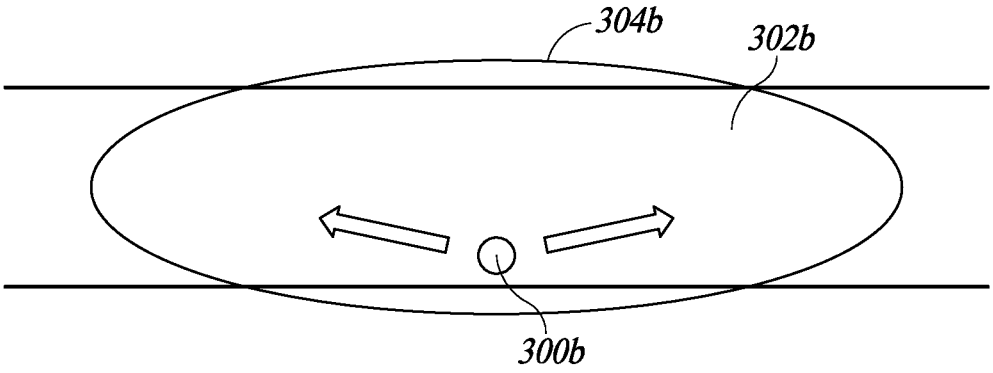

As shown in FIG. 3B, a Type II light distribution pattern 304*b* is suitable for roadways 302*b*, wider walkways, highway on-ramps, and entrance roadways, as well as other applications requiring a long, narrow lighting area. This type of light distribution pattern 304*b* is typically located near the side of a roadway 302*b* or path, such as on smaller side streets or jogging paths. Type II light distributions have a preferred lateral width of 25 degrees. They are generally applicable to a light source 300*b*, e.g., a luminaire, located at or near the side of relatively narrow roadways 302*b*, e.g., where the width of the roadway 302*b* is less than or equal to 1.75 times the designed mounting height. In implementations, the lateral width may be in a range which is approximately plus or minus 20% the preferred lateral width, e.g., approximately 20 degrees to 30 degrees. In such a case, the luminaire may include secondary optics, e.g., lenses and reflectors, which can direct light emitted by LED strings to form a desired illumination pattern.

Figure 3C:
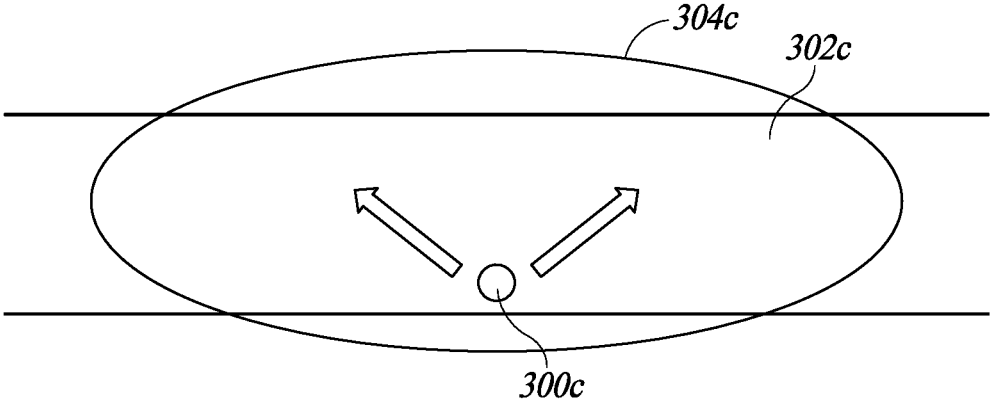

As shown in FIG. 3C, a Type III light distribution pattern 304*c* is suitable for general roadway 302*c* lighting, parking areas, and other areas where a larger area of lighting is required. This type of lighting is typically placed to the side of the area to be illuminated—allowing the light to project outward and fill the area. Type III light distribution patterns have a preferred lateral width of 40 degrees. This type of light distribution pattern is applicable for a light source 300*c*, e.g., a luminaire, mounted at or near the side of medium-width roadways 302*c* or areas, e.g., where the width of the roadway 302*c* or area is less than or equal to 2.75 times the mounting height. In implementations, the lateral width may be in a range which is approximately plus or minus 20% the preferred lateral width (which may be rounded to the nearest 10 degrees), e.g., approximately 30 degrees to 50 degrees.

Figure 3D:
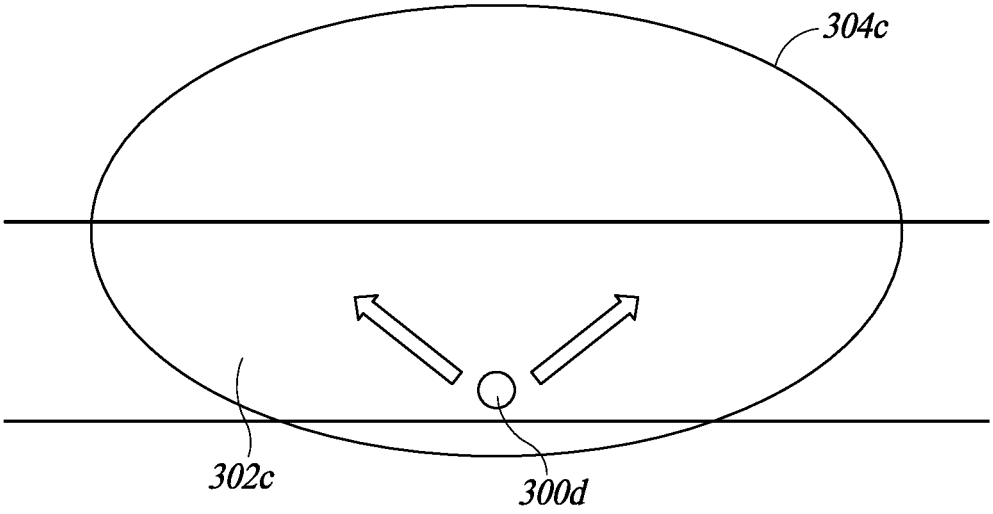

As shown in FIG. 3D, a Type IV light distribution pattern 304*d* illuminates a semicircular area and is suitable for mounting for roadways 302*d* and various types of ground areas, as well as on the sides of buildings and walls. This type of light distribution pattern 304*d* is particularly suitable for illuminating the perimeter of parking areas and businesses. The Type IV light distribution pattern 304*d* has the same intensity at angles from 90 degrees to 270 degrees has a preferred lateral width of 60 degrees. This light distribution pattern 304*d* is suitable for a side of roadway 302*d* mounting and is generally used on wide roadways 302*d*, e.g., where the roadway width is less than or equal to 3.7 times the mounting height.

Figure 3E:
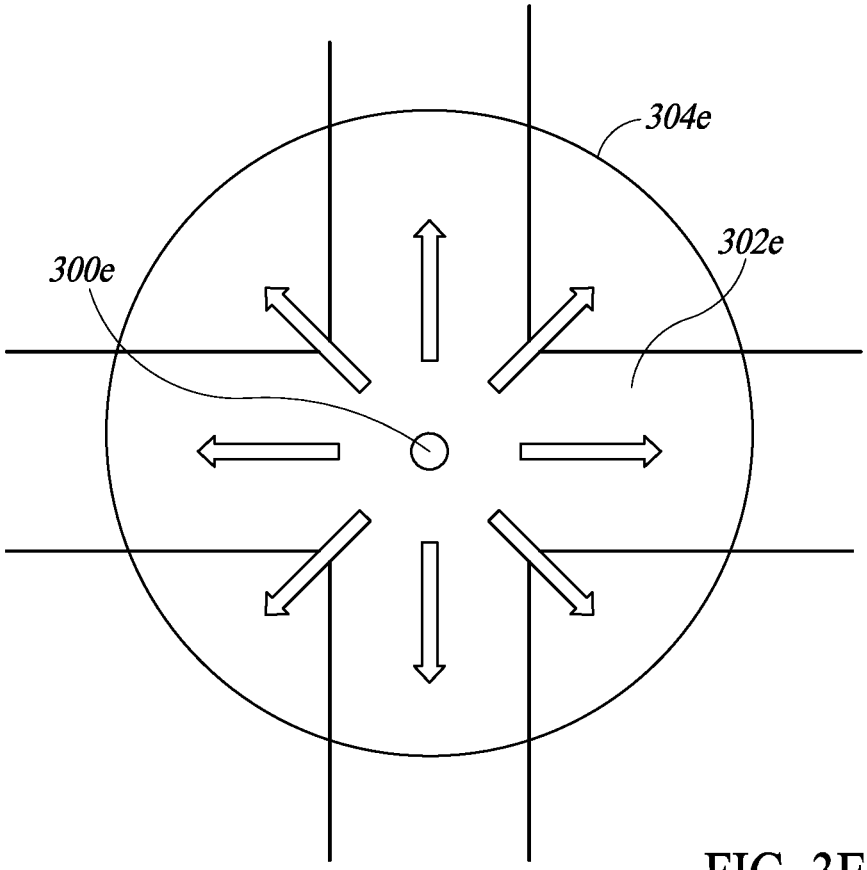

As shown in FIG. 3E, a Type V light distribution pattern 304*e* produces a circular, i.e., 360°, distribution that has equal light intensity in all directions. This type of light distribution pattern 304*d* is suitable for a light source 300*e*, e.g., a luminaire, mounted at or near the center of a roadway 302*e* and is particularly suitable for parking areas or flooding large areas of light directly in front of the fixture. In implementations, a Type "VS" distribution (not shown) may produce an approximately square light distribution pattern.

Figure 4A:
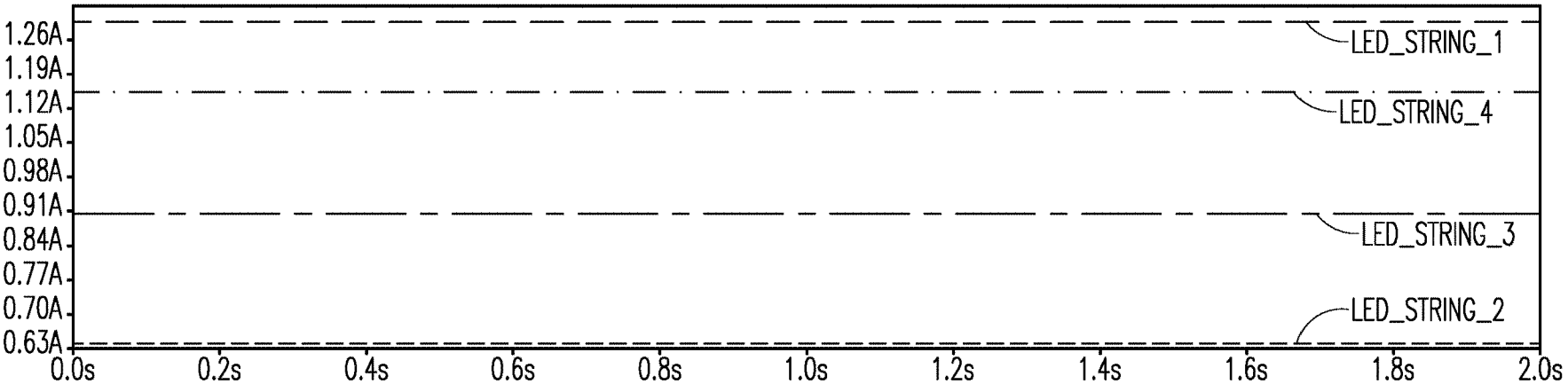
FIG. 4A is a circuit schematic diagram that shows a circuit comprising four sets of solid state light sources (e.g., LEDs) electrically coupled in parallel with one another to a constant current source, a respective resistor electrically coupled in series with each set of solid state light sources, and a respective shunt path provided via a solid state switch for each set, according to at least one illustrated implementation.
Figure 4A:
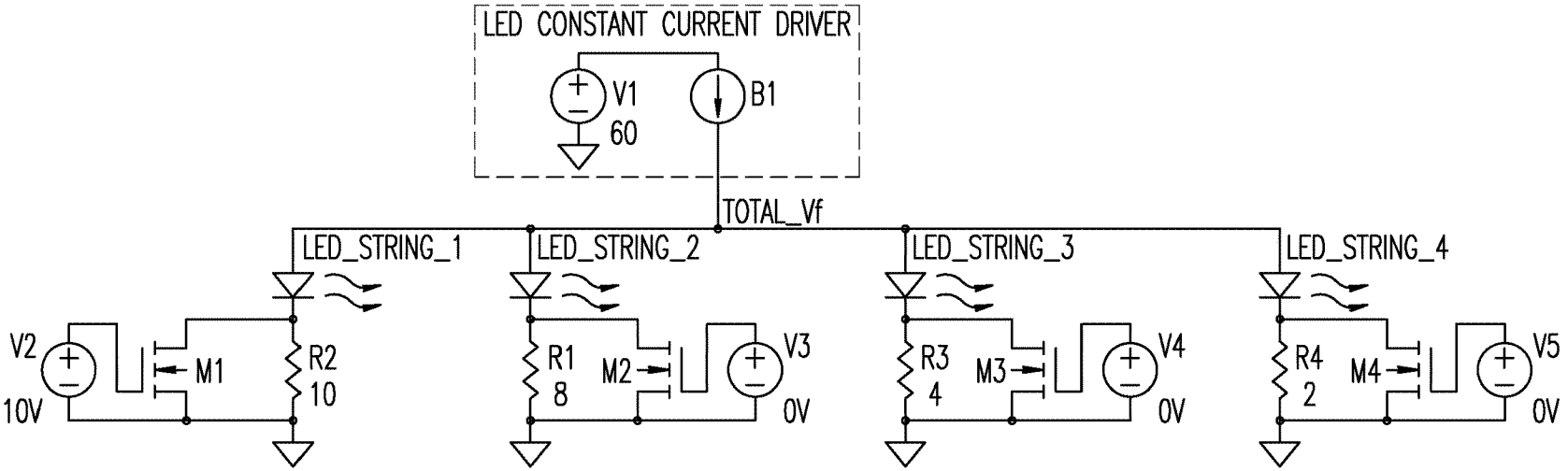

FIG. 4A is a circuit schematic diagram that shows a circuit comprising four sets of solid state light sources (e.g., LEDs) electrically coupled in parallel with one another to a constant current source, a respective resistor electrically coupled in series with each set of solid state light sources, and a respective shunt path provided via a solid state switch for each set, according to at least one illustrated implementation. As explained in further detail below, the brightness of one or more, but not all, of forward voltage matched LED strings (i.e., light source circuits) may be controlled using passive resistance with very low power loss. For example, if multiple parallel LED strings are matched in forward voltage, one or more of the strings may be dimmed to a less than their full brightness level. This may be accomplished, for example, by using a fixed or variable resistance (e.g., a combination of a resistor and a switched shunt path) in series with each light source circuit to be dimmed, which minutely lowers the voltage across the string (i.e., set) of light sources to be dimmed, such that the light sources (e.g., LEDs) conduct substantially less current and emit less light. In such a case, the forward voltage drop across both strings remains substantially the same due to the highly non-linear current versus voltage curve of the LEDs, as discussed below with respect to FIG. 5. Thus, the added resistors, in effect, "steer" the current from the constant current source so that the current is decreased in the set of light sources to be dimmed. There is a corresponding increase in current in the remaining set(s) of light sources which results in a brightening of the respective light sources. The brightened strings also maintain a forward voltage that is substantially the same—even with increased current through those strings.

In implementations, the solid state switch may be constituted by a transistor, e.g., a MOSFET. Voltages may be selectively applied to the gates of the transistors to put each switch in an on or off state. For example, the application of, e.g., 10 Volts to the gate of the MOSFET may put the MOSFET into the on state, whereas application of 0 Volts may put the MOSFET into the off state. When a solid-state switch is in the on state (i.e., a state which allows current to pass through the switch—from source to drain, or vice versa), current passes primarily through the switch, thereby effectively bypassing the resistor. When a solid state switches in the off state, the shunt path becomes an open circuit, thereby causing all of the current to flow through the resistor. Thus, in effect, the switch operates to switch the resistance into or out of the respective light source circuit. In this example, there are four light source circuits connected in parallel to the constant current source. In implementations, two of the light source circuits may be arranged along a first axis of a light, e.g., a luminaire, automobile headlamp, etc., with the two light source circuits extending from a central portion of the light in opposite directions. Similarly, the other two light source circuits may be arranged along a second axis of the light and may extend from a central portion of the light in opposite directions.

In implementations, as depicted in FIG. 4A, the resistors of the light source circuits differ in value, e.g., 2 Ohms, 4 Ohms, 8 Ohms, and 10 Ohms, respectively. In such a case, when all of the switches are in the on state, the current through each of the light source circuits will differ proportionally. In the example depicted, more current will flow through LED String 4 than through any of the other light source circuits, which means that the light sources of this string will be proportionally brighter than any of the other strings, i.e., light source circuits. Such a configuration, in effect, creates a default state in which the light source circuits have differing levels of brightness. As the switches are selectively activated or deactivated, various combinations of brightness for the light source circuits can be achieved.

Figure 4B:
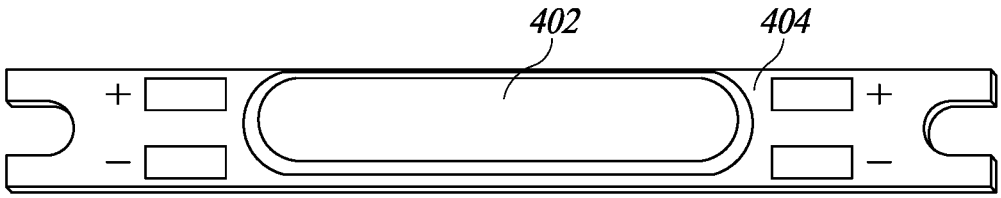
FIG. 4B is a plan view of a set of LEDs in a chip-on-board configuration mounted on a metal heatsink.

FIG. 4B is a plan view of a set of LEDs 402 in a chip-on-board configuration mounted on a metal heatsink 404. The term "chip-on-board" (COB) refers to the mounting of bare LED chips in direct contact with a substrate (e.g., silicon carbide or sapphire), which allows for a much higher packing density of a set of LEDs than in conventional configurations, such as surface mounted devices. In implementations, each of the four strings may be a single chip-on-board (COB) LED array. In some cases, off-the-shelf COBs may be well enough matched in forward voltage so that no additional matching circuitry is needed. In implementations, the forward voltage of a set of COBs may be within a range of +/−1% of a nominal value for a given test current. In some implementations, the forward voltage of a set of COBs may be within +/−0.2% of a nominal value for a given test current. The four COBs may be mounted on an isothermal plane composed of an aluminum heatsink. All LEDs are maintained at substantially the same temperature, e.g., by use of thermal interface compounds, heat spreading materials, and the like. The isothermal construction of the LED strings with respect to each other prevents unwanted forward voltage changes of one string relative to another in the case of ambient temperature extremes or due to self-heating of the un-dimmed strings relative to the dimmed strings. That is, LEDs may exhibit a negative thermal coefficient of forward voltage of approximately 3 mV/° C. Therefore, a string of, e.g., 18 LEDs may increase in forward voltage by approximately 0.05 V/° C.

In implementations, matched COB LED strings may be driven by a single constant current LED driver, such as a XLG-200-H-AB from MeanWell Corporation. The COB LEDs may be mounted in a "diamond" shape, such that two of the LED strings are aligned along a first axis parallel to an area of desired maximum illumination, e.g., a roadway. The other two LED strings may be aligned along a second axis which is non-parallel (e.g., perpendicular) to the area of maximum illumination. In one example, passive resistive dimming elements (e.g., resistors) may be inserted into the perpendicular strings (i.e., the strings aligned along the second axis) so as to dim them to a low level by means of a static switch, e.g., a rotary switch. Alternatively, a MOSFET or other semiconductor switch can be used as the static switch. With the two perpendicular LED strings dimmed to a low level, or dimmed to off, the resulting light pattern from this light source may be an IESNA Type 2 roadway illumination pattern (see FIG. 3B). In another example, one of the perpendicular LED string extending toward the roadway could be "un-dimmed" by shorting the passive dimming resistor (e.g., by closing a switch in a shunt path which bypasses the resistor), by substituting a resistor of a different resistance value, by changing the static switch to a different position, or by activating a different semiconductor static switch. This case may give a resulting light pattern such as an IESNA Type 3 roadway illumination pattern (see FIG. 3C). In another example, if all of the LED stings are un-dimmed by means of changing the resistive dimmers to a low resistance, an illumination pattern substantially corresponding to an IESNA Type 5 roadway illumination pattern may result (see FIG. 3E). Thus, a single rotary switch, or one or more semiconductor switches, could control the illumination patterns of a luminaire to enable the selection of an appropriate light pattern at the time of installation or after installation.

Referring again to FIG. 4A, the depicted example is an implementation with multiple MOSFET switches and series resistors (and a plot of the current through each LED string obtained by simulation). In this example, MOSFET M1 is switched to a very low resistance by gate voltage V1 and shorts resistor R2 thereby effectively removing it from the circuit. A larger current flows through LED String 1 (e.g., about 2 amps) than through any of the other LED strings so that more light is emitted from LED String 1. For example, LED String 2 may have a current of about 0.65 amps, LED String 3 may have a current of 0.9 amps, and LED String 4 may have a current of about 1.15 amps. The illumination pattern produced by this configuration has light emitted from LED String 1 more represented than each of the other LED strings, thereby shaping the illumination pattern produced by the combined array. LED String 2 has the largest series resistance, and therefore the lowest voltage across the LED string, and emits the least light relative to the other LED strings.

Figure 5:
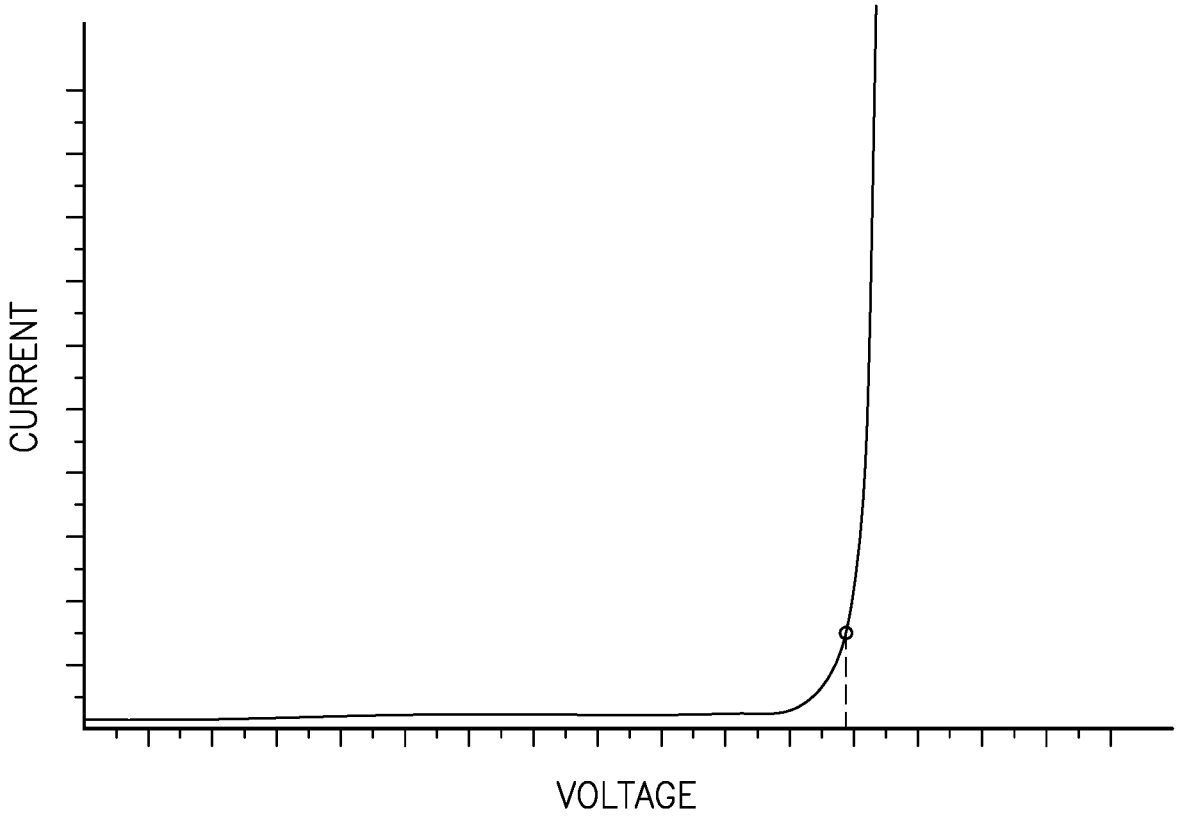
FIG. 5 is a plot of current versus voltage for a number of interconnected solid-state light sources of a light source circuit, according to at least one illustrated implementation.

FIG. 5 is a plot of current versus voltage for a number of interconnected solid-state light sources of a light source circuit, according to at least one illustrated implementation. The plot shows that there is a highly non-linear relationship of LED current to applied voltage. As explained above, the brightness of one or more (but not all) of the light source circuits, e.g., forward voltage matched LED strings, may be controlled using passive resistance with very low power loss, because the forward voltage drop across the dimmed strings remains substantially the same due to the highly non-linear current versus voltage curve of LEDs, with the un-dimmed string maintaining a similar forward voltage even with increased current through that LED string. In implementations, the forward voltage, Vf, on a full-on string of LEDs may be about, e.g., 50.0 V, while the Vf of a dimmed string may be about, e.g., 47.4 V, which is about 6% lower than the full-on string.

In implementations, a passive resistor-based dimming circuit dissipates a small amount of power due to the highly non-linear current versus voltage nature of LEDs. A resistive dissipation of approximately 2% of the total power of the LED strings without dimming has been found when one string has a passive dimming resistive element causing the light output of the dimmed string to be approximately 10% of the non-dimmed string. In such cases, the total power consumed by all matched strings is very close to the same whether dimming is used or not. For example, a 200 W LED driver driving four matched strings has been shown to draw 192 W from a 120 VAC line with no strings dimmed. If one string is dimmed by a series resistance of 50 Ohms, the total power consumed increases only to 194 W. The three un-dimmed strings become correspondingly brighter relative to the dimmed string. This provides the significant benefit of a substantially constant light output of the combined matched LED strings.

Figure 6:
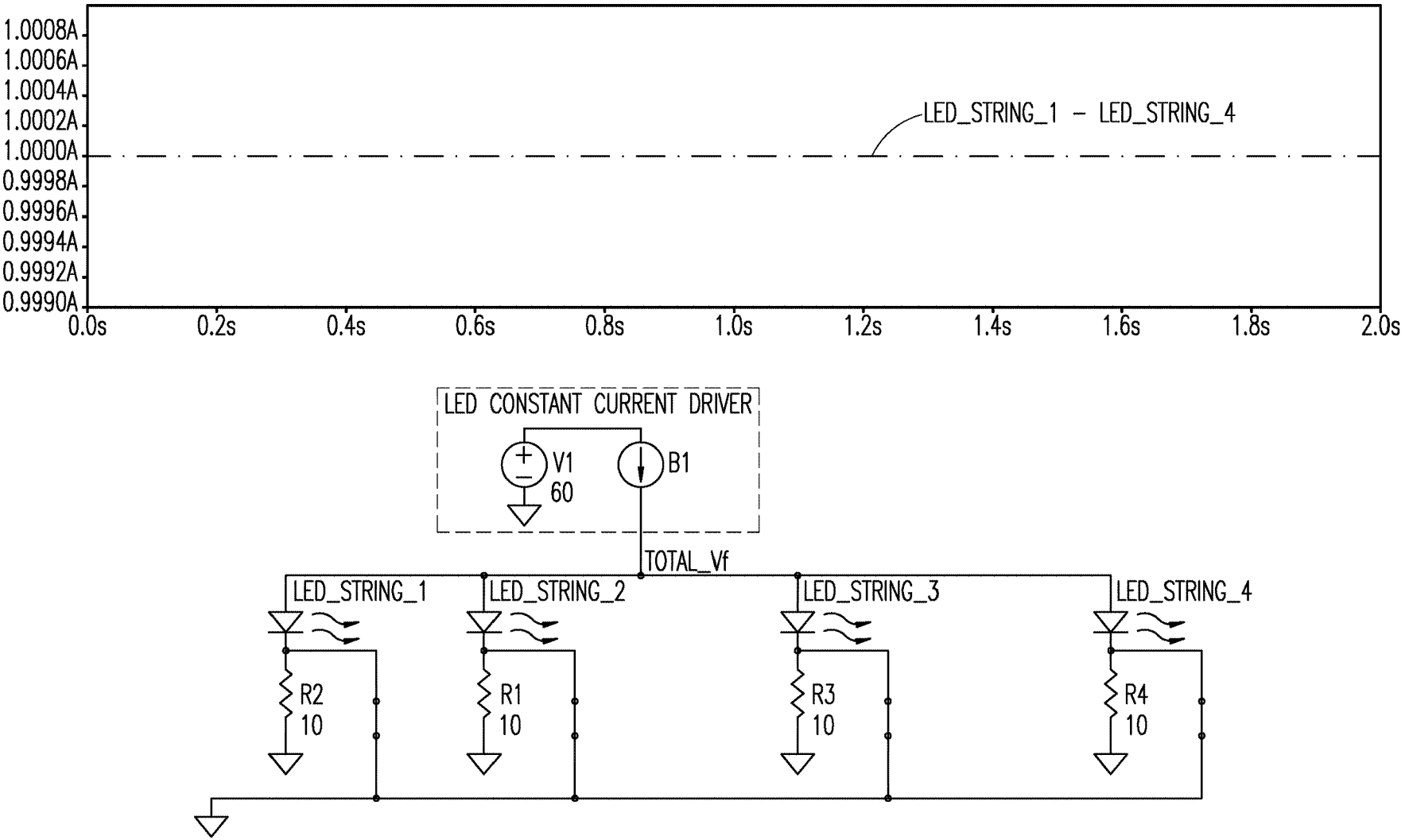
FIG. 6 is a circuit schematic diagram that shows a circuit comprising four sets of solid state light sources (e.g., LEDs) electrically coupled in parallel with one another to a constant current source, a respective resistor, and respective shunt path with a switch, the resistors having a same value of resistance as one another, the switches illustrated in an open state and thus not providing any shunt around the corresponding resistors, according to at least one illustrated implementation.

FIG. 6 is a circuit schematic diagram that shows a circuit comprising four sets of solid state light sources (e.g., LEDs) electrically coupled in parallel with one another to a constant current source, a respective resistor, and respective shunt path with a switch, the resistors having a same value of resistance as one another, the switches illustrated in an closed (i.e., "on") state and providing a shunt path around the corresponding resistors, according to at least one illustrated implementation. In the example depicted, when all of the switches are in the "on" state, all of the resistors are bypassed, i.e., shunted, and the current through each of the light source circuits will be the same, e.g., about 1 amp. Thus, the default state created in this configuration is one in which the brightness of each of the light source circuits is the same. As the switches are selectively activated (i.e., turned on to allow current to flow) or deactivated (i.e., turned off to block current flow), thereby selectively providing a shunt path around the resistor or an open circuit which forces all of the current through the resistor, respectively, various combinations of brightness for the light source circuits can be achieved. In operation, all of the switches could be put into the on position so that all of the resistors were bypassed (as depicted here), resulting in equal illumination for all four of the light source circuits, thereby providing the illumination for an IESNA Type V light distribution pattern.

Figure 7:
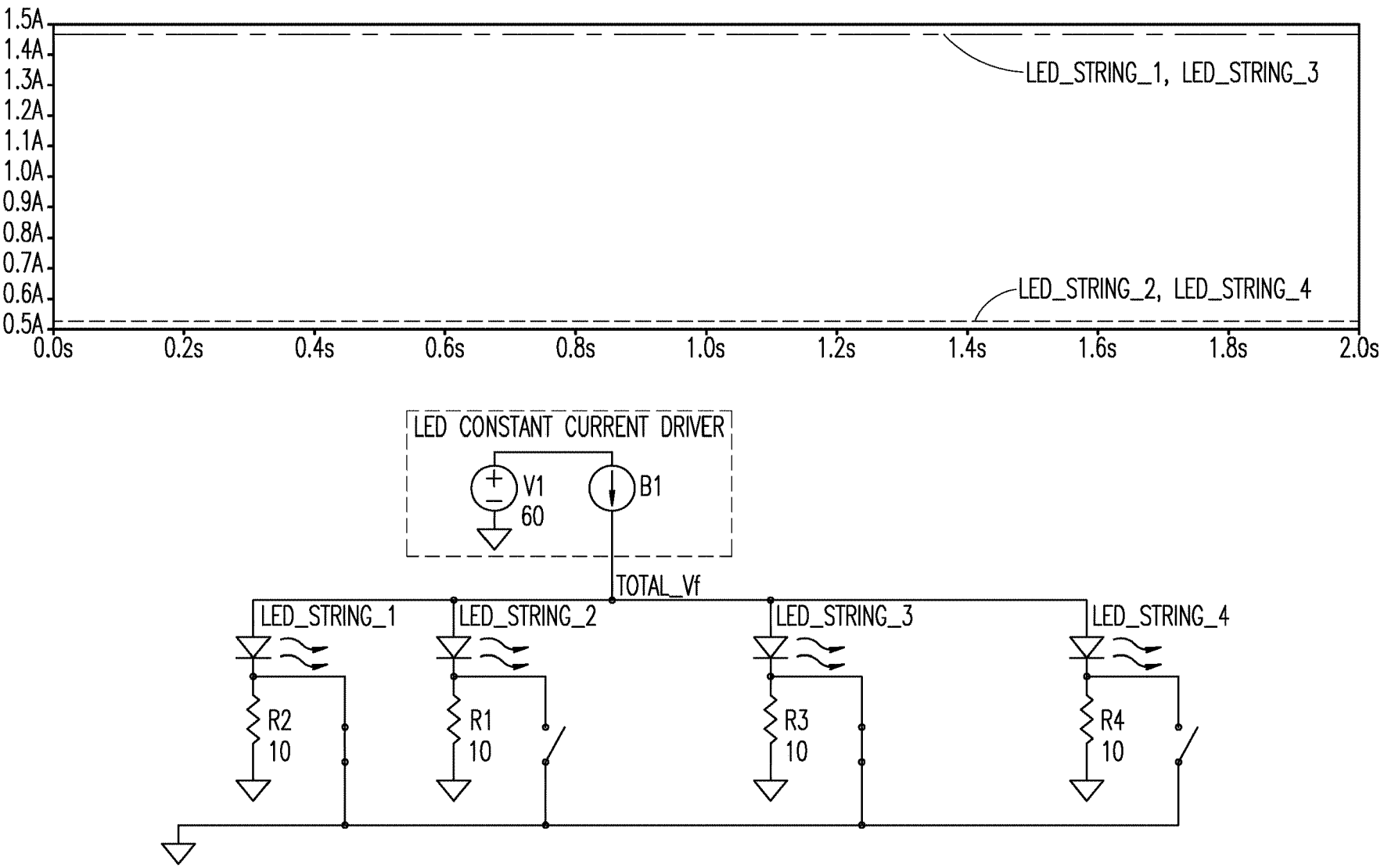
FIG. 7 is a circuit schematic diagram that shows a circuit comprising four sets of solid state light sources (e.g., LEDs) electrically coupled in parallel with one another to a constant current source, a respective resistor, and respective shunt path with a switch for each set, the resistors having a same value of resistance as one another, two of the switches illustrated as in an open state, thus not providing a shunt around the corresponding resistors, and two of the switches illustrated as in a closed state to provide shunts around the corresponding resistors, according to at least one illustrated implementation.

FIG. 7 is a circuit schematic diagram that shows a circuit comprising four sets of solid state light sources (e.g., LEDs) electrically coupled in parallel with one another to a constant current source, a respective resistor, and respective shunt path with a switch for each set, the resistors having a same value of resistance as one another, two of the switches illustrated as in an open (i.e., "off") state, thus not providing a shunt around the corresponding resistors, and two of the switches illustrated as in a closed (i.e., "on") state to provide shunts around the corresponding resistors, according to at least one illustrated implementation. As in the implementation depicted in FIG. 6, the default state created in this configuration is one in which the brightness of each of the light source circuits is the same, and as the switches are selectively activated or deactivated various combinations of brightness for the light source circuits can be achieved. For example, two of the switches can be put into the off position to switch the, e.g., 10 Ohm resistors into the two respective light source circuits, in which case the current through the shunted paths (e.g., LED String 1 and LED String 3) may be, e.g., about 1.5 amps, while the current in the paths into which the 10 ohm resistor has been switched (e.g., LED String 2 and LED String 4) may be, e.g., about 0.5 amps, thereby dimming the respective light source circuits to provide a Type II light distribution pattern.

Figure 8:
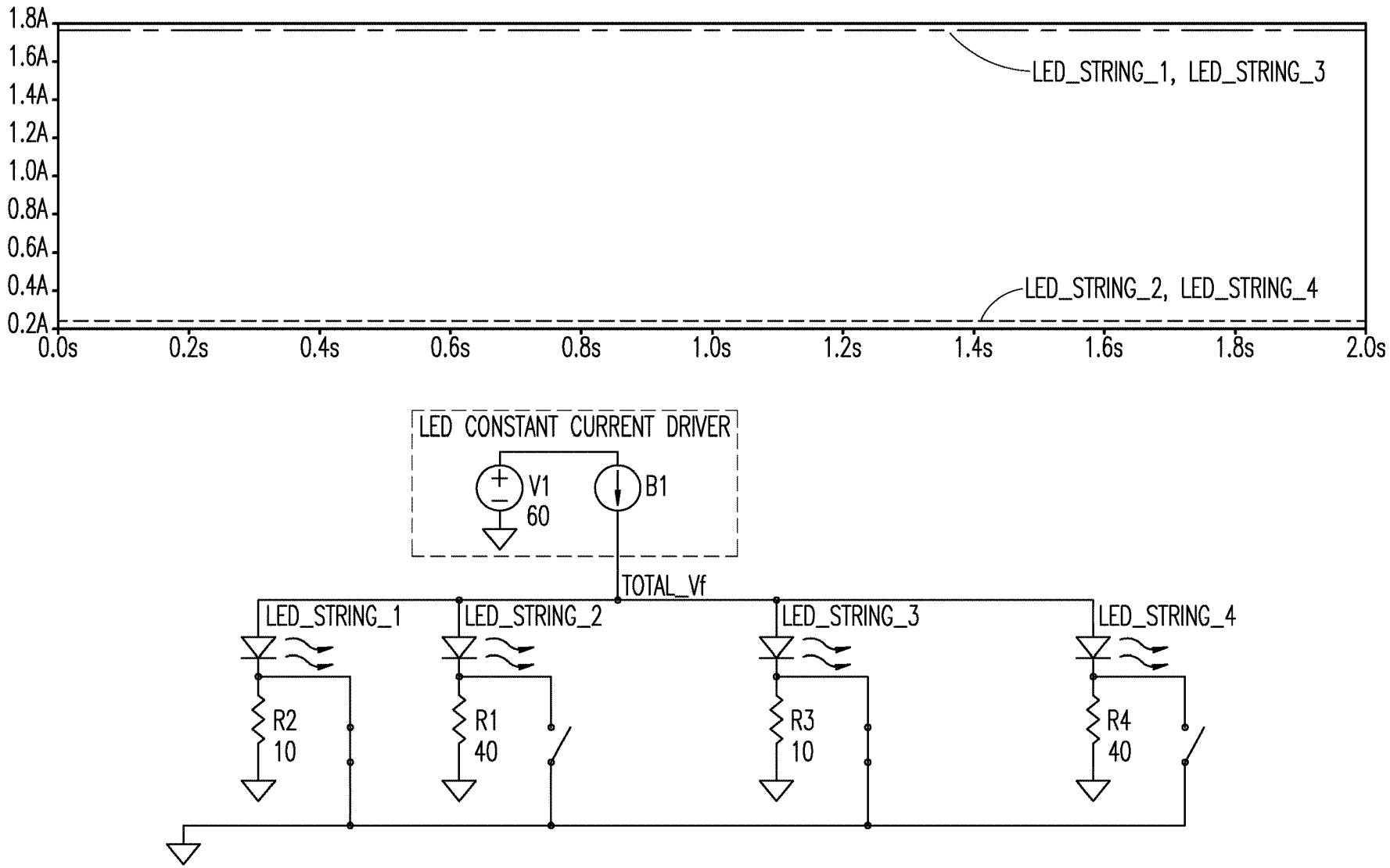
FIG. 8 is a circuit schematic diagram that shows a circuit comprising four sets of solid state light sources (e.g., LEDs) electrically coupled in with one another parallel to a constant current source, a respective resistor, and a shunt path with a switch for each set, the resistors associated with two of the sets a higher value of resistance than the resistors associated with the other two sets, two of the switches that optionally provide shunt paths around the resistors having the relatively higher resistance illustrated in an open state, and two of the switches that optionally provide shunt paths around the resistors having relatively lower resistance illustrated in a closed state, according to at least one illustrated implementation.

FIG. 8 is a circuit schematic diagram that shows a circuit comprising four sets of solid state light sources (e.g., LEDs) electrically coupled in with one another parallel to a constant current source, a respective resistor, and a shunt path with a switch for each set, the resistors associated with two of the sets a higher value of resistance than the resistors associated with the other two sets, two of the switches that optionally provide shunt paths around the resistors having the relatively higher resistance illustrated in an open (i.e., "off") state, and two of the switches that optionally provide shunt paths around the resistors having relatively lower resistance illustrated in a closed (i.e., "on") state, according to at least one illustrated implementation. In implementations, the resistors of the light source circuits differ in value, e.g., 10 Ohms, 40 Ohms, 10 Ohms, and 40 Ohms, respectively. In such a case, when all of the switches are in the on state, the current through each of the light source circuits will differ proportionally. In the example depicted, more current will flow through LED String 1 and LED String 3 than through the other two light source circuits, which means that the light sources of these strings will be proportionally brighter than any of the other strings, i.e., light source circuits. Such a configuration, in effect, creates a default state in which the light source circuits have differing levels of brightness. As the switches are selectively activated or deactivated, various combinations of brightness for the light source circuits can be achieved. For example, two of the switches can be put into the off position to switch the, e.g., 40 Ohm resistors into the two respective light source circuits, thereby dimming the respective light source circuits to provide a Type II light distribution pattern.

Figure 9:
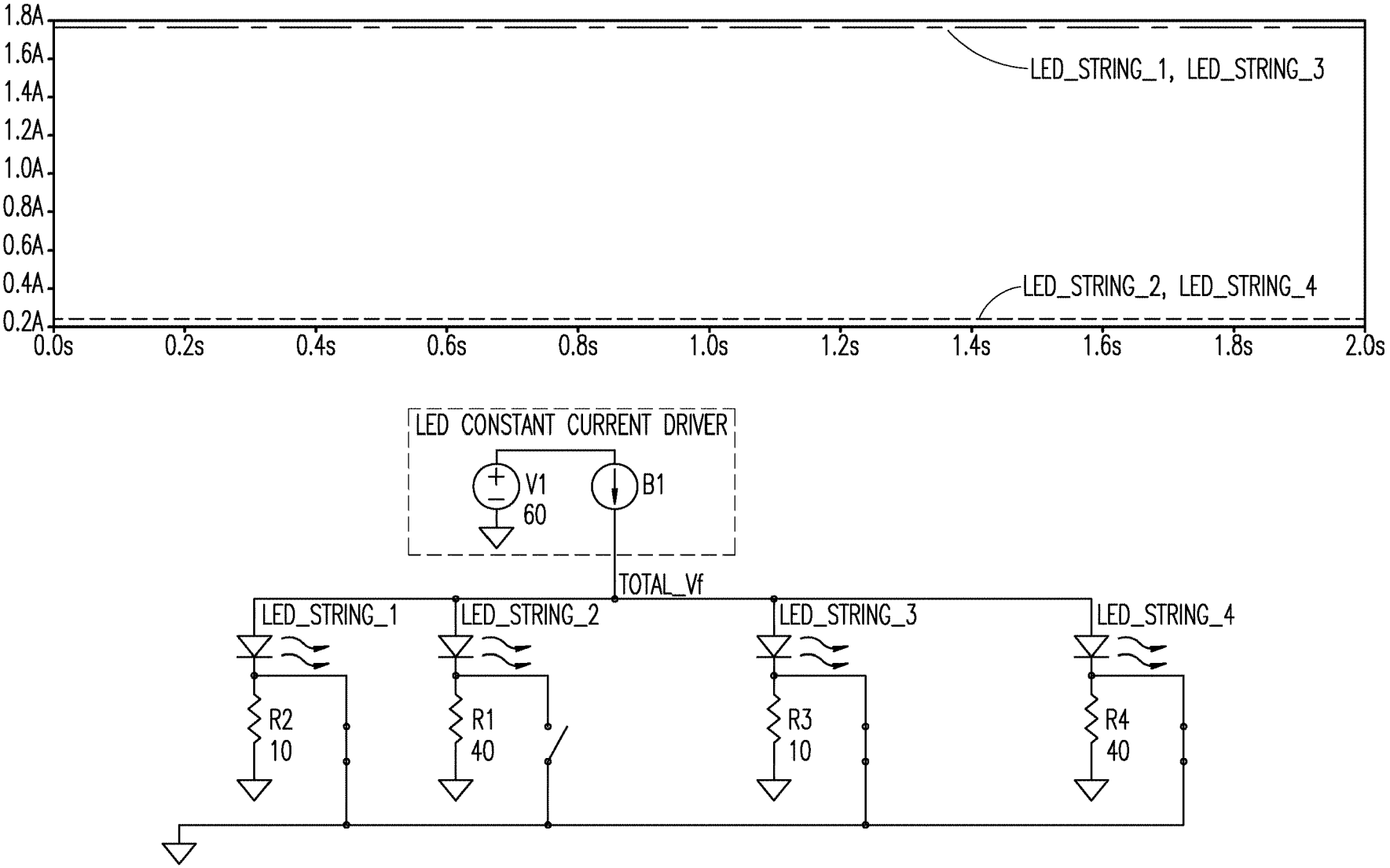
FIG. 9 is a circuit schematic diagram that shows a circuit comprising four sets of solid state light sources (e.g., LEDs) electrically coupled in parallel with one another to a constant current source, a respective resistor, and a shunt path with a switch for each set, the resistors of two of the sets having a higher resistance than the resistors of the other two sets, the switch that optionally provides one of the shunt paths around one of the resistors having the relatively lower resistance being illustrated in an open state, and the switches that optionally provide the other shunt paths illustrated in a closed state, according to at least one illustrated implementation.
Figure 10:
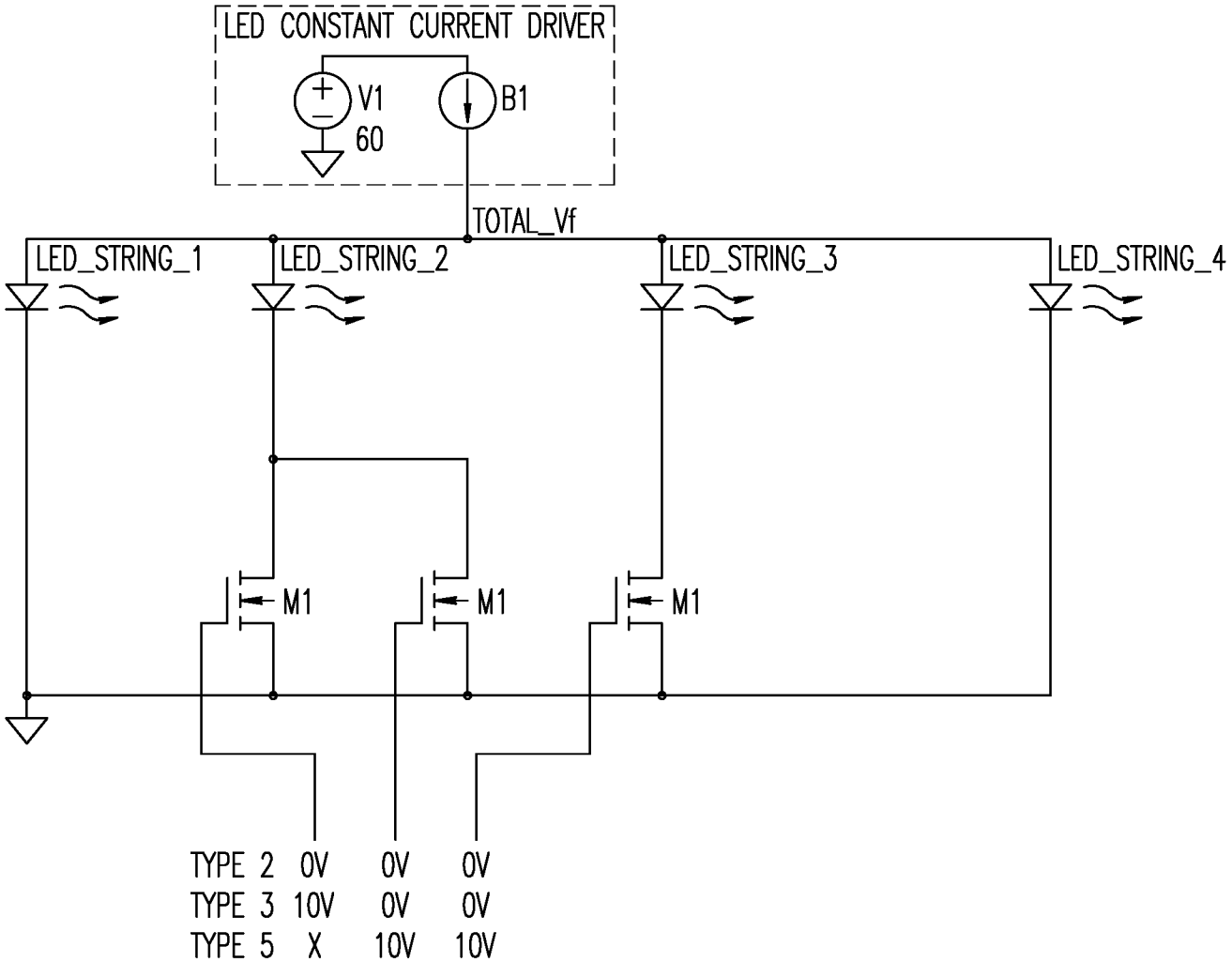
FIG. 10 is a circuit schematic diagram that shows a circuit comprising four sets of solid state light sources (e.g., LEDs) electrically coupled in parallel to a constant current source, a resistor and a first switch electrically coupled in series with one of the sets of solid state light sources along with a switch that provides a shunt path to bypass the resistor, another switch electrically coupled to another one of the sets of solid state light sources without a respective resistor or shunt path, according to at least one illustrated implementation.

FIG. 9 is a circuit schematic diagram that shows a circuit comprising four sets of solid state light sources (e.g., LEDs) electrically coupled in parallel with one another to a constant current source, a respective resistor, and a shunt path with a switch for each set, the resistors of two of the sets having a higher resistance than the resistors of the other two sets, the switch that optionally provides one of the shunt paths around one of the resistors having the relatively lower resistance being illustrated in an open (i.e., "off") state, and the switches that optionally provide the other shunt paths illustrated in a closed (i.e., "on") state, according to at least one illustrated implementation. In implementations, the resistors of the light source circuits differ in value, e.g., 10 Ohms, 40 Ohms, 10 Ohms, and 40 Ohms, respectively. In such a case, when all of the switches are in the on state, the current through each of the light source circuits will differ proportionally. In the example depicted, more current will flow through LED String 1 and LED String 3 than through the other two light source circuits, which means that the light sources of these strings will be proportionally brighter than any of the other strings, i.e., light source circuits. Such a configuration, in effect, creates a default state in which the light source circuits have differing levels of brightness. As the switches are selectively activated or deactivated, various combinations of brightness for the light source circuits can be achieved. For example, one of the switches can be put into the off position to switch one of the, e.g., 40 Ohm resistors into the respective light source circuit, thereby dimming the respective light source circuit to provide a Type IV light distribution pattern FIG. 10 is a circuit schematic diagram that shows a circuit comprising four sets of solid state light sources (e.g., LEDs) electrically coupled in parallel to a constant current source, a resistor and a first switch electrically coupled in series with one of the sets of solid state light sources along with a switch that provides a shunt path to bypass the resistor, another switch electrically coupled to another one of the sets of solid state light sources without a respective resistor or shunt path, according to at least one illustrated implementation. In the example depicted, three MOSFET transistors control two of four matched LED strings, i.e., light source circuits, to allow the output of the light to be switched to an IESNA Type II, Type III, or Type V using, for example, a mechanical rotary switch or slide switch, independent mechanical switches, or by output lines from a microcontroller. A state table presented in FIG. 10 indicates which MOSFETs are switched to conduction mode, i.e., switched to an "on" state, to achieve each of these light distributions types.

In implementations, to achieve a Type II light distribution output (see FIG. 3B), an input of 0 Volts is applied to each of the three MOSFET switches—putting the switches in the "off" state. In such a case, both LED String 1 and LED String 4 are connected to ground such that current flows through the LEDs corresponding to these light source circuits, which may be arranged along a first axis which is aligned with an elongate area being illuminated, e.g., a roadway. In addition, both LED String 2 and LED String 3 are open circuited so that no current flows to the corresponding light sources, which may be light sources arranged along a second axis which is perpendicular to the first axis and therefore in a direction perpendicular to the elongate area being illuminated.

To achieve a Type III light distribution output (see FIG. 3C), an input of 0 Volts is applied to two of the three MOSFET switches (putting the switches in the "off" state), specifically, the MOSFET in the shunt path of LED String 2 and the MOSFET in the path of LED String 3. An input of 10 Volts is applied to the MOSFET in the resistor path of LED String 2. In such a case, both LED String 1 and LED String 4 are connected to ground such that current flows through the LEDs corresponding to these light source circuits, which may be arranged along a first axis which is aligned with an elongate area being illuminated, e.g., a roadway. In addition, LED String 2 is connected to ground through its resistor path such that the LEDs corresponding to this light source circuit are illuminated but dimmed with respect to LED String 1 and LED String 2. The LEDs corresponding to LED String 2 may be arranged along a second axis which is perpendicular to an elongate area being illuminated, e.g., a roadway, in a forward direction of the light (e.g., a direction toward the roadway). LED String 3 is open circuited so that no current flows to the corresponding light sources, which may be light sources arranged along the second axis but in a rearward direction of the light (e.g., a direction away from the roadway and toward residences and/or businesses).

To achieve a Type IV light distribution output (see FIG. 3E), an input of 10 Volts is applied to the MOSFETs in the shunt path of LED String 2 and the path of LED String 3. In such a case, both LED String 1 and LED String 4 are connected to ground such that current flows through the LEDs corresponding to these light source circuits, which may be arranged along a first axis which is aligned with an elongate area being illuminated, e.g., a roadway. In addition, LED String 2 is connected to ground through its shunt path (the MOSFET in series with the resistor LED String 2 can be on or off—an "x" or "don't care" input) and LED String 3 is also connected to ground such that current flows through the LEDs corresponding to these light source circuits without dimming relative to the other light source circuits. The LEDs corresponding to these light source circuits may be arranged along a second axis which is perpendicular to the elongate area being illuminated.

Figure 11:
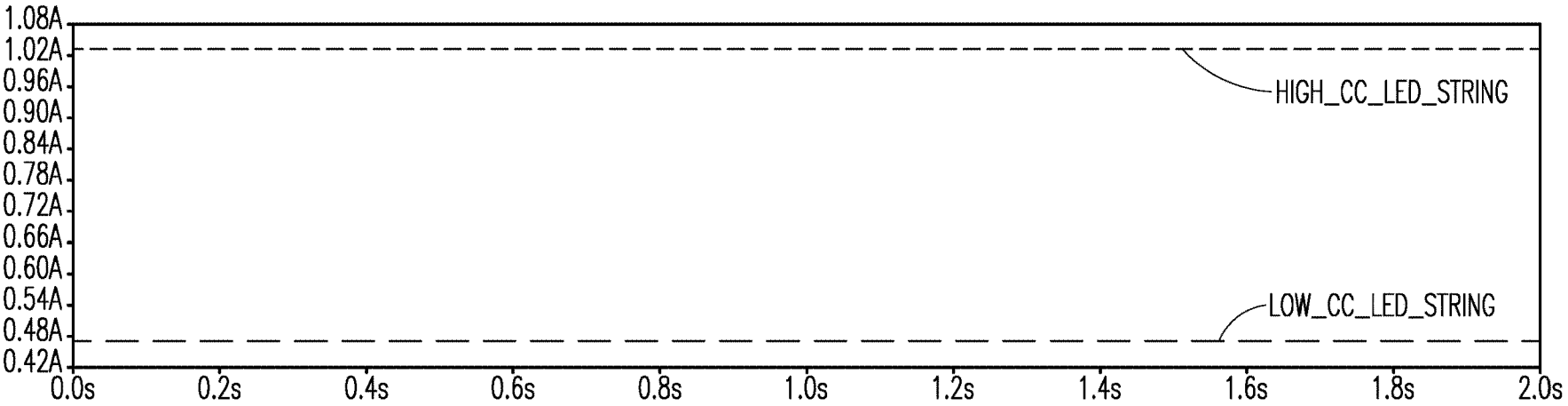
FIG. 11 is a circuit schematic diagram that shows two sets of solid state light sources (e.g., LEDs) electrically coupled in with one another parallel with one another to a constant current source, a respective resistor, and respective shunt path with a switch for each set, the solid state light sources of at least one of the sets having a higher color temperature than a respective color temperature of the solid state light sources of at least one of the other sets of solid state light sources, according to at least one illustrated implementation.
Figure 11:
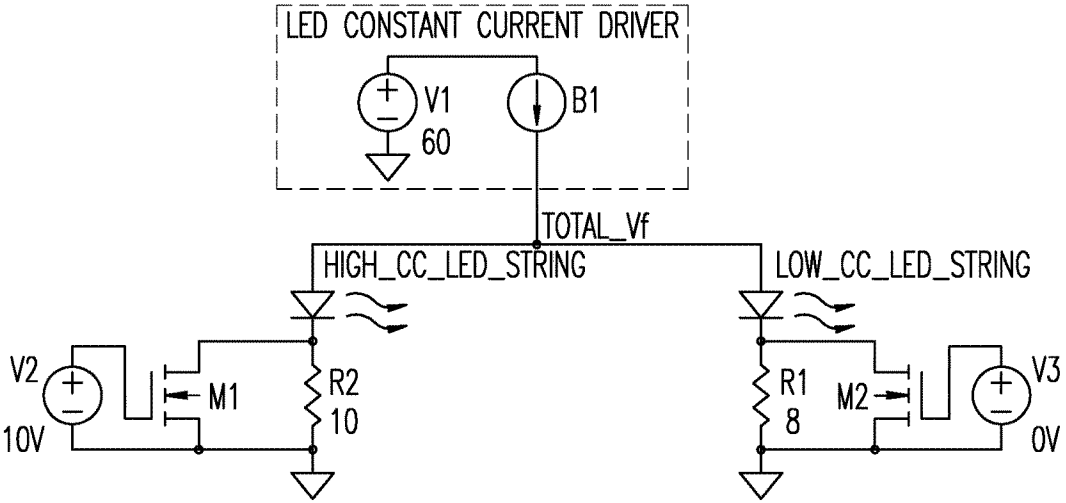

FIG. 11 shows two light source circuits connected in parallel to a constant current source, each light source circuit including a number of solid state light sources, a resistor, and a shunt path with a switch, the light sources of one of the light source circuits having a higher color temperature than the light sources of the other light source circuit, according to at least one illustrated implementation. In implementations, a number of matched LED strings (e.g., two strings) of different color spectrums are connected in parallel, where one string may be a higher color temperature, e.g., 5600K Correlated Color Temperature (CCT), and the other string may have a lower color temperature, e.g., 2200K CCT. In such a case, the current from the constant current LED driver may be steered mostly through the 5600K LED string to produce a cooler light emission spectrum or through the 2200K LED string to produce a warmer spectrum. In this way, a luminaire may have an adjustable emission spectrum so that one model of a light or luminaire may be used in multiple applications. In the example depicted, solid state switches, e.g., MOSFET transistors (M1 and M2), may be used to switch in the respective dimming resistors by opening or closing a shunt path which bypasses each respective resistor. In implementations, multiple MOSFETs, each connected with a different value resistor, may be used to make multiple steps of light color adjustment. In the example depicted, a 10 ohm resistor (R1) is used to selectively lower the forward voltage of the Low_CCT_LED string. The MOSFET (M1) shorts resistor R2, thereby removing it from the circuit. This results in more current from the constant current supply flowing through the High CCT LED string than the Low CCT string, thereby increasing CCT of the combination of the two strings.

The various embodiments described above can be combined and/or modified to provide further embodiments in light of the above-detailed description, including the material incorporated by reference. All of the U.S. patents, U.S. patent application publications, U.S. patent applications, foreign patents, foreign patent applications and non-patent publications referred to in this specification and/or listed in the Application Data Sheet, including but not limited to U.S. Provisional Application No. 62/930,283, filed Nov. 4, 2019, are incorporated herein by reference, in their entirety. Aspects of the embodiments can be modified, if necessary to employ concepts of the various patents, applications and publications to provide yet further embodiments.

In general, in the following claims, the terms used should not be construed to limit the claims to the specific implementations disclosed in the specification and the claims, but should be construed to include all possible implementations along with the full scope of equivalents to which such claims are entitled. Accordingly, the claims are not limited by the disclosure.

The invention claimed is:

1. A light comprising:

a first set of one or more electrically coupled solid state light sources having a first forward voltage drop across the first set of solid state light sources;

a second set of one or more electrically coupled solid state light sources having a second forward voltage drop across the second set of solid state light sources, the second forward voltage drop at least approximately matching the first forward voltage drop;

a constant current source to which the first set of solid state light sources and at least the second set of solid state light sources are electrically coupled in parallel;

at least one resistor electrically coupled to at least one of the first set and the second set of solid state light sources; and a set of control circuitry that is operably coupled to control a resistance electrically coupled in series with said at least one of the first set and the second set of solid state light sources, the resistance being provided by said at least one resistor, to adjust a respective current through said at least one of the first set and the second set of solid state light sources and thereby dim said at least one of the first set and the second set of solid state light sources while maintaining the respective forward voltage drop across the first set and the second set of solid state light sources substantially constant.

2. The light of claim 1 wherein the set of control circuitry is operably coupled to control the resistance electrically coupled in series with said at least one of the first set and the second set of solid state light sources, the resistance being provided by said at least one resistor, to adjust the respective current through said at least one of the first set and the second set of solid state light sources and thereby dim said at least one of the first set and the second set of solid state light sources and to brighten correspondingly another one of the first set and the second set of solid state light sources.

3. The light of claim 1 wherein the set of control circuitry comprises:

a shunt path bypassing said at least one resistor; and at least one switch operable in a first state to cause current to pass through said at least one resistor and operable in a second state to cause current to pass through the shunt path.

4. The light of claim 3 wherein said at least one switch comprises a solid state switch.

5. The light of claim 3 wherein said at least one switch comprises a mechanical or electromechanical switch.

6. The light of claim 1 wherein said at least one resistor is a variable resistor and the set of control circuitry is operable to adjust a resistance of the variable resistor.

7. The light of claim 1 wherein the first set and the second set of solid state light sources each comprise a chip-on-board light emitting diode circuit.

8. The light of claim 1 wherein the first set and the second set of solid state light sources are communicatively coupled to a common isothermal structure comprising a heatsink.

9. The light of claim 1 wherein the first set and the second set of solid state light sources have a negative thermal coefficient of less than about 3 millivolts per degree Celsius.

10. The light of claim 1 wherein:

the first set of one or more solid state light sources has a first correlated color temperature and the second set of one or more solid state light sources has a second correlated color temperature, the first correlated color temperature being different from the second correlated color temperature, and the set of control circuitry is operably coupled to control the resistance electrically coupled in series with said at least one of the first set and the second set of solid state light sources, the resistance being provided by said at least one resistor, to adjust the respective current through said at least one of the first set and the second set of solid state light sources and thereby dim said at least one of the first set and the second set of solid state light sources to output light having a combined correlated color temperature in a range between the first correlated color temperature and the second correlated color temperature.

11. The light of claim 1 wherein at least the second set of one or more solid state light sources is arranged to extend along a first axis and at least the first set of one or more solid state light sources is arranged to extend along a second axis, the second axis being non-parallel to the first axis.

12. The light of claim 11 wherein the second axis is perpendicular to the first axis and the light further comprises a mount positioned and oriented to allow installation of the light so that the first axis is aligned with an elongate area to provide maximum illumination to the elongate area and the second axis is aligned perpendicularly to the elongate area.

13. The light of claim 11 wherein at least the first set of one or more solid state light sources is selectively dimmable to form:

a first illumination pattern; and a second illumination pattern, the second illumination pattern different than the first illumination pattern.

14. The light of claim 13 wherein the first illumination pattern provides maximum illumination to an elongate area with a light distribution having a lateral width of between about 20 degrees and about 30 degrees, the second illumination pattern which provides maximum illumination to an elongate area with a light distribution having a lateral width of between about 30 degrees and about 50 degrees, and at least the first set of one or more solid state light sources is selectively dimmable to further form a third illumination pattern which provides maximum illumination to a circular area.

15. The light of claim 14 wherein the first, second, and third illumination patterns correspond to IESNA Types II, III, and V light distribution patterns, respectively.

16. The light of claim 1, further comprising:

a third set of one or more electrically coupled solid state light sources having a third forward voltage drop across the third set of solid state light sources, the third forward voltage drop at least approximately matching the first forward voltage drop, wherein:

the first set, the second set, and the third set of solid state light sources are electrically coupled to the constant current source in parallel, said at least one resistor is electrically coupled to at least one of the first set, the second set, and the third set of solid state light sources, and the set of control circuitry is operably coupled to control a resistance electrically coupled in series with said at least one of the first set, the second set, and the third set of solid state light sources, the resistance being provided by said at least one resistor, to adjust a respective current through said at least one of the first set, the second set, and the third set of solid state light sources and thereby dim said at least one of the first set, the second set, and the third set of solid state light sources, wherein the control circuitry is operable to selectively dim one or more of the first, the second and the third sets of one or more solid state light sources to at least one of adjust a combined color temperature output by the light or to adjust a combined illumination pattern produced by the light.

17. A method to control a light comprising a first set of one or more electrically coupled solid state light sources having a first forward voltage drop across the first set of solid state light sources, and a second set of one or more electrically coupled solid state light sources having a second forward voltage drop across the second set of solid state light sources, the second forward voltage drop at least approximately matching the first forward voltage drop, the method comprising:

receiving current from a constant current source to which the first set of solid state light sources and at least the second set of solid state light sources are electrically coupled in parallel; and controlling, using an operably coupled set of control circuitry, a resistance electrically coupled in series with said at least one of the first set and the second set of solid state light sources, the resistance provided by at least one resistor electrically coupled to at least one of the first set and the second set of solid state light sources, to adjust a respective current through said at least one of the first set and the second set of solid state light sources and thereby dim said at least one of the first set and the second set of solid state light sources.

18. The method of claim 17 wherein, in said controlling the resistance electrically coupled in series with said at least one of the first set and the second set of solid state light sources to adjust the respective current through said at least one of the first set and the second set of solid state light sources and thereby dim said at least one of the first set and the second set of solid state light sources, the respective forward voltage drop across the first set and the second set of solid state light sources remain substantially constant.

19. The method of claim 17 wherein the first set of one or more solid state light sources has a first correlated color temperature and the second set of one or more solid state light sources has a second correlated color temperature, the first correlated color temperature being different from the second correlated color temperature, and wherein controlling the resistance electrically coupled in series with said at least one of the first set and the second set of solid state light sources to adjust the respective current through said at least one of the first set and the second set of solid state light sources includes controlling the resistance to output light having a combined correlated color temperature in a range between the first correlated color temperature and the second correlated color temperature.

20. The method of claim 17 wherein the light further comprises a third set of one or more electrically coupled solid state light sources having a third forward voltage drop across the third set of solid state light sources, and at least a fourth set of one or more electrically coupled solid state light sources having a fourth forward voltage drop across the fourth set of solid state light sources, the third and the fourth forward voltage drops at least approximately matching the first forward voltage drop, and at least one of the third or the fourth sets of one or more electrically coupled solid state light sources extending in a direction that is non-parallel a direction in which at least one of the first or the second sets of one or more electrically coupled solid state light sources extend, and wherein:

controlling the resistance electrically coupled in series with said at least one of the first set and the second set of solid state light sources to adjust the respective current through said at least one of the first set and the second set of solid state light sources includes controlling a resistance electrically coupled in series with said first, second, third and fourth sets of one or more electrically coupled solid state light sources to select a throw pattern cast by the light.

* * * * *